US009233561B2

(12) United States Patent
Yoshihisa et al.

(10) Patent No.: US 9,233,561 B2
(45) Date of Patent: Jan. 12, 2016

(54) RECORDING APPARATUS

(71) Applicant: SEIKO EPSON CORPORATION, Tokyo (JP)

(72) Inventors: Yasuhiko Yoshihisa, Nagano (JP); Katsumi Yamada, Nagano (JP); Hiroshi Shirotori, Nagano (JP); Katsuhito Suzuki, Nagano (JP); Tomio Sonehara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/289,054

(22) Filed: May 28, 2014

(65) Prior Publication Data

US 2015/0035887 A1 Feb. 5, 2015

(30) Foreign Application Priority Data

| | | |
|---|---|---|
| Aug. 2, 2013 | (JP) | 2013-161366 |
| Aug. 2, 2013 | (JP) | 2013-161389 |
| Aug. 2, 2013 | (JP) | 2013-161401 |
| Aug. 2, 2013 | (JP) | 2013-161420 |
| Aug. 2, 2013 | (JP) | 2013-161436 |

(51) Int. Cl.

| | |
|---|---|
| ***B41J 3/407*** | (2006.01) |
| ***B41J 11/00*** | (2006.01) |
| ***B41J 13/00*** | (2006.01) |
| ***B41J 13/10*** | (2006.01) |
| ***B41J 19/14*** | (2006.01) |
| ***B41J 3/60*** | (2006.01) |

(52) U.S. Cl.
CPC *B41J 11/009* (2013.01); *B41J 3/60* (2013.01); *B41J 13/0018* (2013.01); *B41J 13/103* (2013.01); *B41J 19/142* (2013.01)

(58) Field of Classification Search
CPC ..... B41J 3/407; B41J 3/4073; B41J 2/5056
See application file for complete search history.

(56) References Cited

U.S. PATENT DOCUMENTS

| | | | | |
|---|---|---|---|---|
| 2007/0206084 | A1* | 9/2007 | Suzuki et al. | 347/105 |
| 2010/0013903 | A1* | 1/2010 | Suzuki | 347/244 |
| 2012/0280447 | A1* | 11/2012 | Kayanuma | 271/228 |

FOREIGN PATENT DOCUMENTS

JP 2011-240536 A 12/2011

* cited by examiner

*Primary Examiner* — Geoffrey Mruk
*Assistant Examiner* — Scott A Richmond
(74) *Attorney, Agent, or Firm* — Global IP Counselors, LLP

(57) ABSTRACT

A lens sheet is provided with a lens layer which is formed by arranging lenses, which extend in a y direction as a first direction, in a plurality of lines in an x direction as a second direction which is a direction which is orthogonal to the first direction, and an ink absorbing layer which configures a surface on the opposite side with regard to a surface which is configured by the lens layer, where the thickness of an edge which is an end surface on one side of the lens layer in the x direction is thinner than the thickness of an edge which is an end surface on the other side. The printer performs recording from the edge which is a reference side toward the edge on the opposite side.

17 Claims, 29 Drawing Sheets

RECORDING APPARATUS

CROSS-REFERENCE TO RELATED APPLICATIONS

This application claims priority to Japanese Patent Application No. 2013-161366 filed on Aug. 2, 2013, Japanese Patent Application No. 2013-161389 filed on Aug. 2, 2013, Japanese Patent Application No. 2013-161401 filed on Aug. 2, 2013, Japanese Patent Application No. 2013-161420 filed on Aug. 2, 2013, and Japanese Patent Application No. 2013-161436 filed on Aug. 2, 2013. The entire disclosures of Japanese Patent Application Nos. 2013-161366, 2013-161389, 2013-161401, 2013-161420, and 2013-161436 are hereby incorporated herein by reference.

BACKGROUND

1. Technical Field

The present invention relates to a recording apparatus which performs recording onto a target recording medium which is configured such that a surface on one side is a lens layer which is configured by a plurality of lenses and a surface of the other side is a recording layer where recording is possible using a recording head.

2. Related Art

Among printers, in particular, ink jet printers which are examples of recording apparatuses which perform recording onto a target recording medium, there are printers where it is possible to select a bidirectional recording mode where ink is ejected from the recording head in both a period where the target recording medium and the recording head move relatively in a predetermined direction and a period where the target recording medium and the recording head move in the reverse direction to the predetermined direction and a single direction recording mode where ink is ejected from the recording head only in a period where the target recording medium and the recording head move relatively in a predetermined direction (refer to Japanese Unexamined Patent Application Publication No. 2011-240536).

Here, media are known in the prior art where it is possible to obtain various types of visual effects by using a lenticular lens such as, for example, stereoscopically showing images which are recorded (a 3D effect), showing images which are different by changing the viewing angle (a changing effect), and imparting movement to images by changing the viewing angle in a gradual manner (a motion effect).

The lenticular lens refers to a collection of lenses where a plurality of elongated lens elements with a semi-cylindrical shape are aligned and it is possible to obtain the various types of visual effects described above by providing images which are respectively different for the left and right eyes of an observer when images are viewed through such a lenticular lens. Then, there is a method, which is an example of a method of recording images in order to obtain visual effects in this manner, where ink jet recording is performed directly with regard to an ink absorbing layer of a medium where the surface, which is on the opposite side to the surface where the lenticular lens is formed, is configured by the ink absorbing layer.

Here, since the target recording medium which is provided with the lenticular lens has high resilience and low flexibility compared to normal sheets, there are restrictions on the transport path such as that it is not possible to carry out transporting on a transport path with a high degree of curvature. However, when forming a transport path which extends with a linear shape in one direction, for example, from the front of the apparatus toward the side of the rear surface or from the side of the rear surface to the front, the feeding side and the discharge side of the target recording medium are different and the ease of handling is reduced when recording is performed.

In addition, there are cases where the target recording medium which is provided with the lenticular lens is created by being cut from a large sheet into a desired size. In this case, there are cases where the lens which is formed at the edge of the target recording medium is in a defective state of not being cut into a perfect semi-cylindrical shape. In more detail, when the cutting position is positioned exactly in a valley between a lens element and another lens element, the lens element which is formed at the edge has a perfect semi-cylindrical shape. However, in a case where the cutting position is positioned in the middle of a lens element, the lens element at the cutting position will not have a perfect semi-cylindrical shape.

Accordingly, when recording starts with a slicing surface of the lens element with an imperfect semi-cylindrical shape as a reference position, an image which is to be recorded originally on one of the lens elements is recorded across another lens element which is adjacent and it is not possible to favorably obtain the various types of visual effects described above as a result.

Therefore, it is desirable to perform recording using a simple method and with high precision with regard to a target recording medium which is provided with a lenticular lens.

SUMMARY

Here, the present invention has been carried out in consideration of these circumstances and has an object of performing recording using a simple method and with high precision with regard to a target recording medium which is configured such that a surface on one side is a lens layer, performing recording with favorable ease of handling with regard to a target recording medium which is provided with a lens, and, furthermore, performing recording using a simpler method with high precision.

In order to solve the problems described above, a recording apparatus according to a first aspect of the present invention is provided with a recording head configured to perform recording with regard to a first target recording medium and a second target recording medium with a sheet shape which is a target recording medium of a type which is different to the first target recording medium and which has a lens layer which is formed by arranging lenses, which extend in a first direction, in a plurality of lines in a second direction which is a direction orthogonal to the first direction and a control unit configured to control the recording head, where, when recording is performed on the first target recording medium, the control unit is configured to select either of a bidirectional recording mode where ink is ejected from the recording head in both a period where the first target recording medium and the recording head move relatively in a predetermined direction and a period where the first target recording medium and the recording head move in a reverse direction to the predetermined direction and a single direction recording mode where ink is discharged from the recording head only in a period where the first target recording medium and the recording head move relatively in a predetermined direction, and the control unit is configured to select a single direction recording mode, when recording is performed on the second target recording medium, where ink is ejected from the recording head only in a period where the second target recording medium and the recording head move relatively in a predetermined direction and to control the recording head so as to perform recording from a side of a reference, which is set on an edge on one side in the second direction in the target recording medium, toward an edge on the other side when ink is ejected from the recording head toward the second target recording medium so as to form an image which corresponds to each of the lenses of the plurality of lenses.

According to the present aspect, since the control unit of the recording apparatus controls the recording head so as to perform recording from the side of the reference, which is set on an edge on one side in the second direction in the target recording medium, toward an edge on the other side, it is possible to easily record the images which are to be recorded with regard to each of the lenses with high precision without performing complicated controlling.

Here, in a case where the edge on one side is formed with higher precision than the edge of the other side, the side of the edge which is formed with high precision is the side of the reference for both edges in a direction which intersects with the transport direction in the target recording medium.

A second aspect of the present invention is further provided with an discharge section where the first target recording medium where recording has been performed is discharged, and a holding section, which is provided on a side which is far from the discharge section so as to interpose a recording region of the recording head and where the second target recording medium is held before recording is started, wherein the second target recording medium is transported from the holding section to the recording region, recording is performed on the second target recording medium, and the second target recording medium is discharged toward the discharge section.

A third aspect of the present invention is further provided with a first discharge section where the first target recording medium is discharged, and a holding section which is provided on the same side as the first discharge section with regard to a recording region of the recording head and where the second target recording medium is held before recording is started, wherein the second target recording medium is transported from the holding section to the recording region, recording is performed on the second target recording medium, and the second target recording medium is discharged toward a second discharge section which is provided on a side which is far from the first discharge section so as to interpose the recording region.

A fourth aspect of the present invention is provided with a first discharge section where the first target recording medium where recording has been performed is discharged, and a holding section which is provided on a side which is far from the first discharge section so as to interpose a recording region of the recording head and where the second target recording medium is held before recording starts, wherein the second target recording medium is transported from the holding section to the recording region, recording is performed on the second target recording medium, and the second target recording medium is discharged toward a second discharge section which is provided on a side which is far from the first discharge section so as to interpose the recording region.

According to the present aspect, since the feeding side (the side where the holding section is provided) and the discharge side (the side where the second discharge section is provided) are on the same side when recording is performed on the second target recording medium which has the lenses, it is possible to perform recording with favorable ease of handling with regard to the second target recording medium which has the lenses.

A fifth aspect of the present invention is provided with an discharge section where the first target recording medium where recording has been performed is discharged, and a holding section which is provided on the same side as the discharge section with regard to a recording region of the recording head and where the second target recording medium is held before recording starts, wherein the second target recording medium is transported from the holding section to the recording region, recording is performed on the second target recording medium, and the second target recording medium is discharged toward the holding section.

According to the present aspect, since the feeding side (the side where the holding section is provided) and the discharge side (the side where the second discharge section is provided) are on the same side when recording is performed on the second target recording medium which has the lenses, it is possible to perform recording with favorable ease of handling with regard to the second target recording medium which has the lenses.

A sixth aspect of the present invention is any one of the first to fifth aspects, wherein a width of the second target recording medium in the second direction of a lens, which is formed at an edge on the side of the reference, is equivalent to a width in the second direction of a lens which is adjacent to the lens which is formed at the edge.

A seventh aspect of the present invention is the sixth aspect, wherein the first direction is a transport direction of the second target recording medium.

In addition, an eighth aspect of the present invention is the seventh aspect, wherein the recording head is configured to perform recording while moving in the second direction.

A ninth aspect of the present invention is the seventh aspect, wherein the first direction is a direction orthogonal to the transport direction of the second target recording medium.

A tenth aspect of the present invention is the ninth aspect, wherein the recording head is fixedly provided and recording is performed in a process where the second target recording medium is transported.

An eleventh aspect of the present invention is the eighth aspect, wherein the recording head has a nozzle row which is formed by arranging a plurality of liquid ejecting holes that are configured to eject a predetermined coloring material along the transport direction of the second target recording medium.

A twelfth aspect of the present invention is the tenth aspect, wherein the recording head has a nozzle row which is formed by arranging a plurality of liquid ejecting holes that are configured to eject a predetermined coloring material along a direction which is orthogonal to the transport direction of the second target recording medium.

A thirteenth aspect of the present invention is the seventh aspect, which is further provided with a detecting unit configured to identify an edge which is set as the reference and detect an identification mark which is formed on the second target recording medium, wherein the control unit is configured to control the recording head so as to perform recording from the side of the reference toward the edge on the other side based on detecting of the identification mark by the detecting unit.

According to the present aspect, since the identification mark is formed on the second target recording medium and the recording apparatus performs recording from the side of the reference toward the edge on the other side based on the detecting of the identification mark, it is possible to reliably start recording from the side of the reference regardless of the orientation of the side of the reference when the second target recording medium is fed into the recording apparatus.

A fourteenth aspect of the present invention is the thirteenth aspect, wherein the identification mark is a notch where one corner section of the second target recording medium is cut out.

According to the present aspect, since the identification mark is a notch where one corner section of the second target recording medium is cut out, it is possible to form the identification mark easily and at low cost.

According to a fifteenth aspect of the present invention the control unit is configured to display content on a display section based on detecting of the identification mark.

According to the present aspect, since the identification mark is formed on the second target recording medium and the control unit displays content on the display section based on the detecting of the identification mark, it is possible to perform suitable recording by prompting a user to carry out necessary processes.

A sixteenth aspect of the present invention is the seventh aspect, wherein a tray which carries the second target recording medium is configured so as to be able to be transported, and recording is performed on the second target recording medium using the recording head in a state of being carried in the tray.

According to the present aspect, since the tray which carries the second target recording medium is configured so as to be able to be transported, and recording is performed using the recording head on the second target recording medium in a state of being carried in the tray, it is possible to carry out transporting in a stable manner on the transport path in the recording apparatus even in a case where the size of the target recording medium is small.

A seventeenth aspect of the present invention is the seventh aspect, wherein the particle diameter of a liquid which is ejected from the recording head toward regions at both end sections of the second target recording medium is larger than the particle diameter of a liquid which is ejected toward a region which is between the regions at both end sections.

In a case of performing so-called borderless recording where recording is performed without a margin at the end sections of the second target recording medium, there is a concern that a portion of liquid, which is discarded in a region which is separated from the end section of the second target recording medium, will float due to becoming a mist, foul the second target recording medium by being reattached to the second target recording medium, and have an adverse effect on the constituent components of the apparatus due to becoming attached.

Therefore, in the present aspect, a particle diameter of the liquid which is ejected toward the regions of both end sections of the second target recording medium is larger than a particle diameter of the liquid which is ejected toward the region between the regions of both end sections. Due to this, there is a tendency for the liquid which is discarded to a region which is separated from the end section of the second target recording medium to fall and it is possible to suppress the liquid from becoming a mist and floating.

BRIEF DESCRIPTION OF THE DRAWINGS

Referring now to the attached drawings which form a part of this original disclosure.

DETAILED DESCRIPTION OF EXEMPLARY EMBODIMENTS

Below, an embodiment of the present invention will be described based on the diagrams, but the present invention is not limited to the embodiment described below and various modifications are possible within the scope of the inventions which are described in the scope of the claims and embodiments of the present invention will be described later under the premise that these embodiments are also included within the scope of the present invention.

Figure 1B:
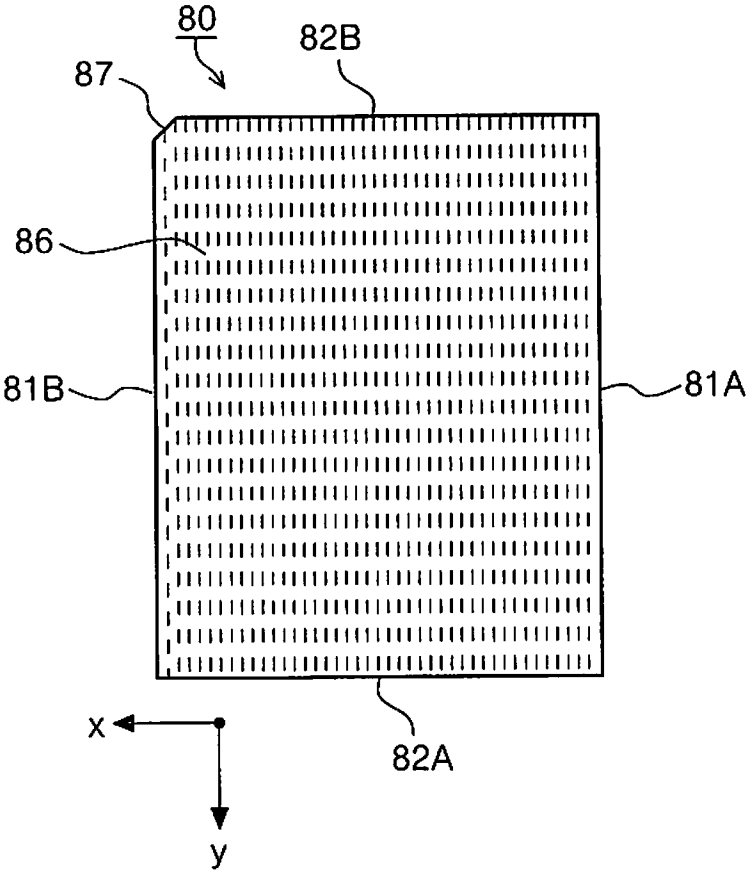
FIG. 1B is a planar diagram where the lens sheet is viewed from an ink absorbing layer side.
Figure 1A:
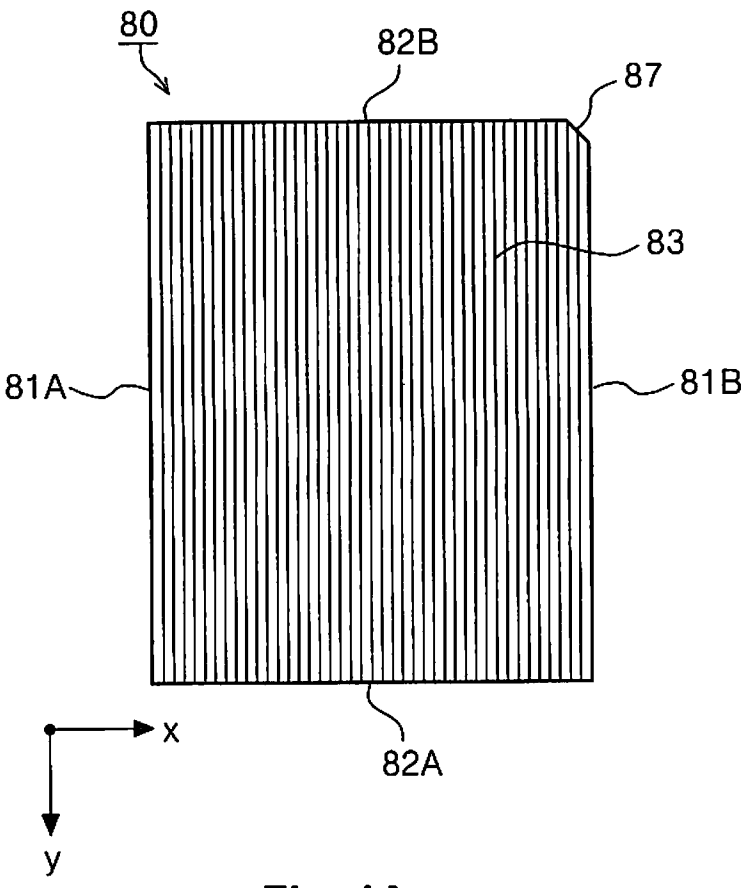
FIG. 1A is a planar diagram where a lens sheet which is an example of a target recording medium according to the present invention is viewed from a lens layer side.
Figure 2:
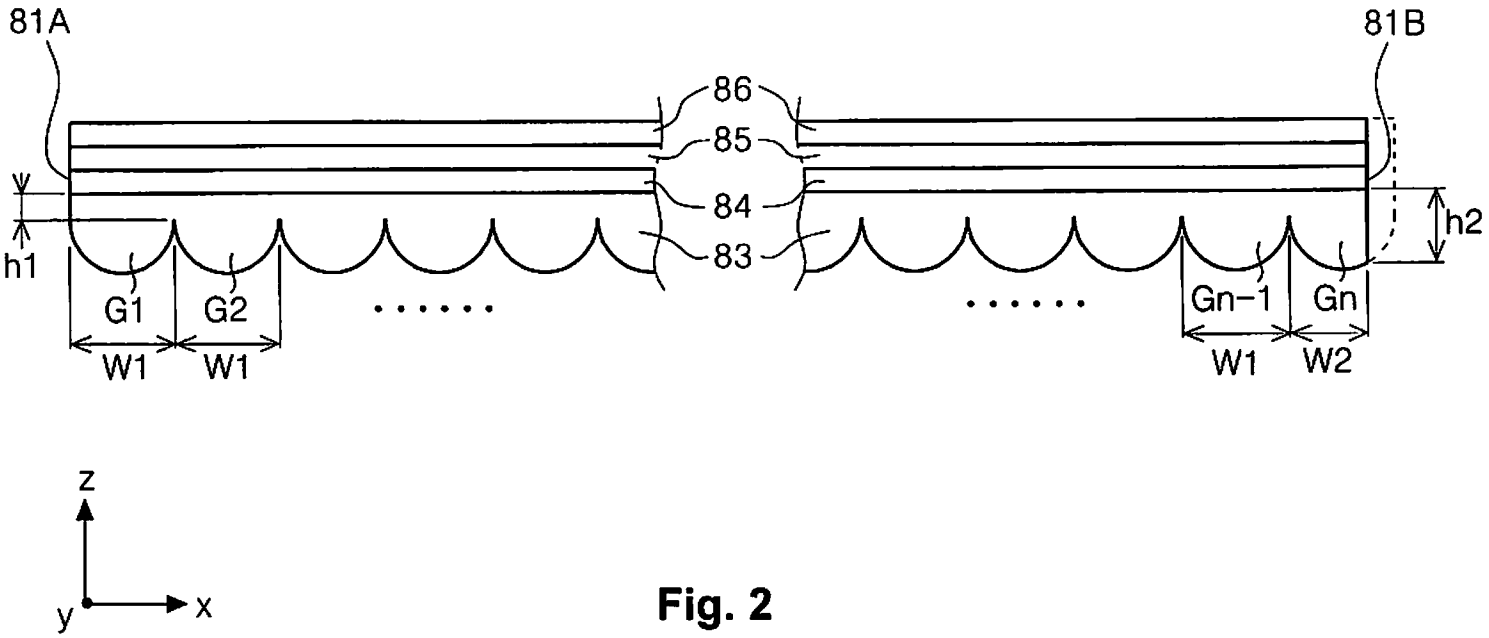
FIG. 2 is a cross sectional diagram where the lens sheet is sliced along an x-z plane.
Figure 3:
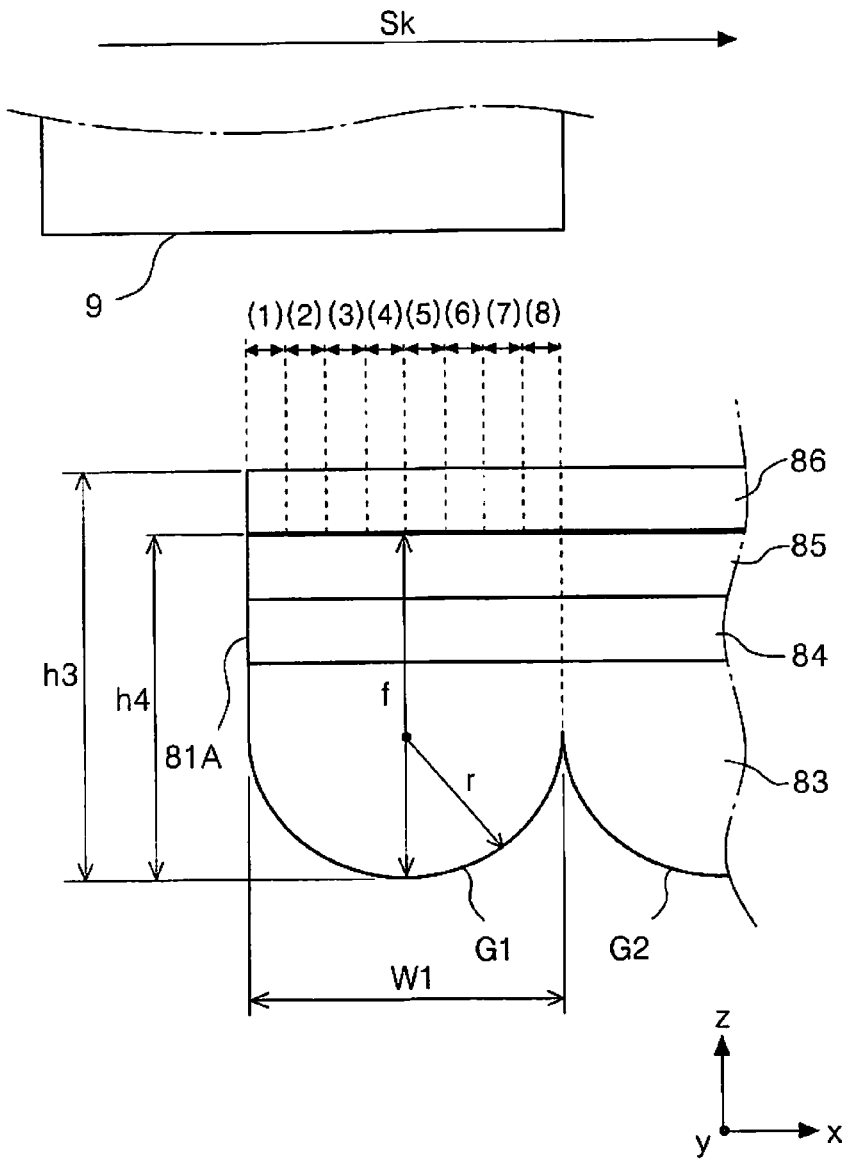
FIG. 3 is a cross sectional diagram where an end surface on one side of the lens sheet in an x direction is sliced along the x-z plane.
Figure 4C:
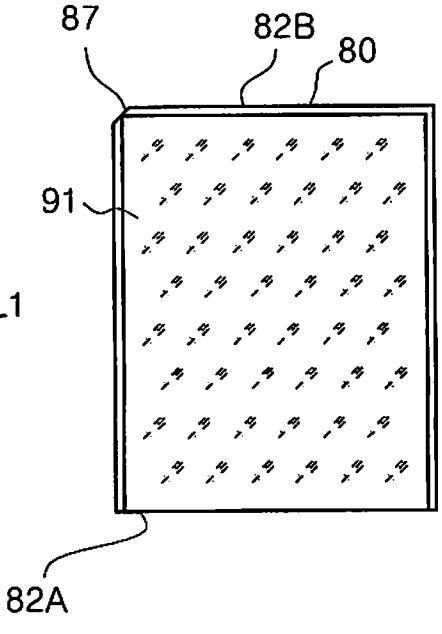
FIG. 4C is the diagram illustrating the process of bonding the label sheet onto the lens sheet.
Figure 4B:
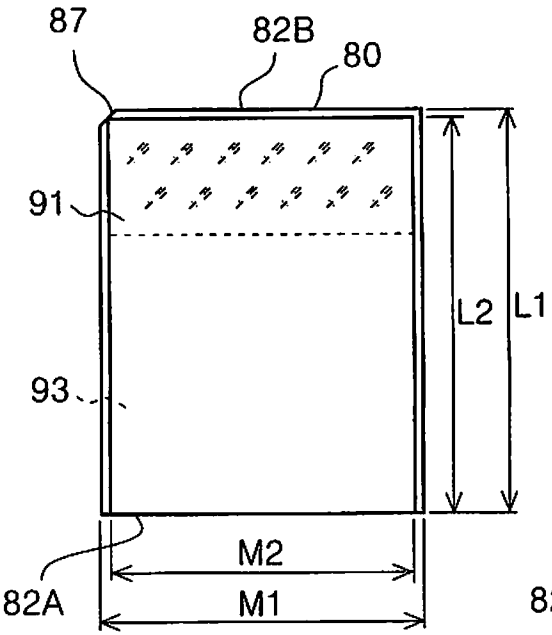
FIG. 4B is the diagram illustrating the process of bonding the label sheet onto the lens sheet.
Figure 4A:
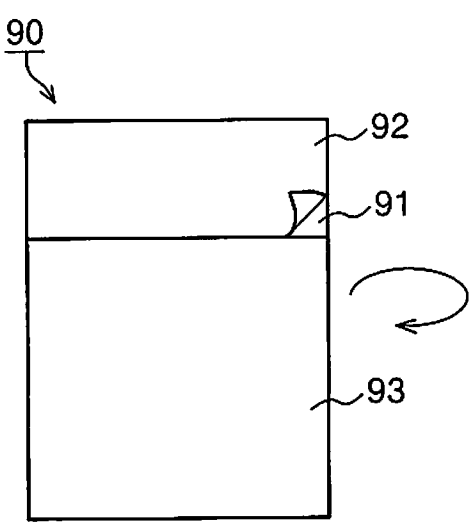
FIG. 4A is a diagram illustrating a process of bonding a label sheet onto the lens sheet.

FIG. 1A is a planar diagram where a lens sheet 80 which is an example of a target recording medium according to the present invention is viewed from a lens layer 83 side, FIG. 1B is a planar diagram where the lens sheet 80 is viewed from an ink absorbing layer 86 side, FIG. 2 is a cross sectional diagram where the lens sheet 80 is sliced along an x-z plane, FIG. 3 is a cross sectional diagram where an end surface on one side of the lens sheet 80 in an x direction is sliced along the x-z plane, and FIGS. 4A to 4C are diagrams illustrating a process of bonding a label sheet 90 onto the lens sheet 80.

Figure 5:
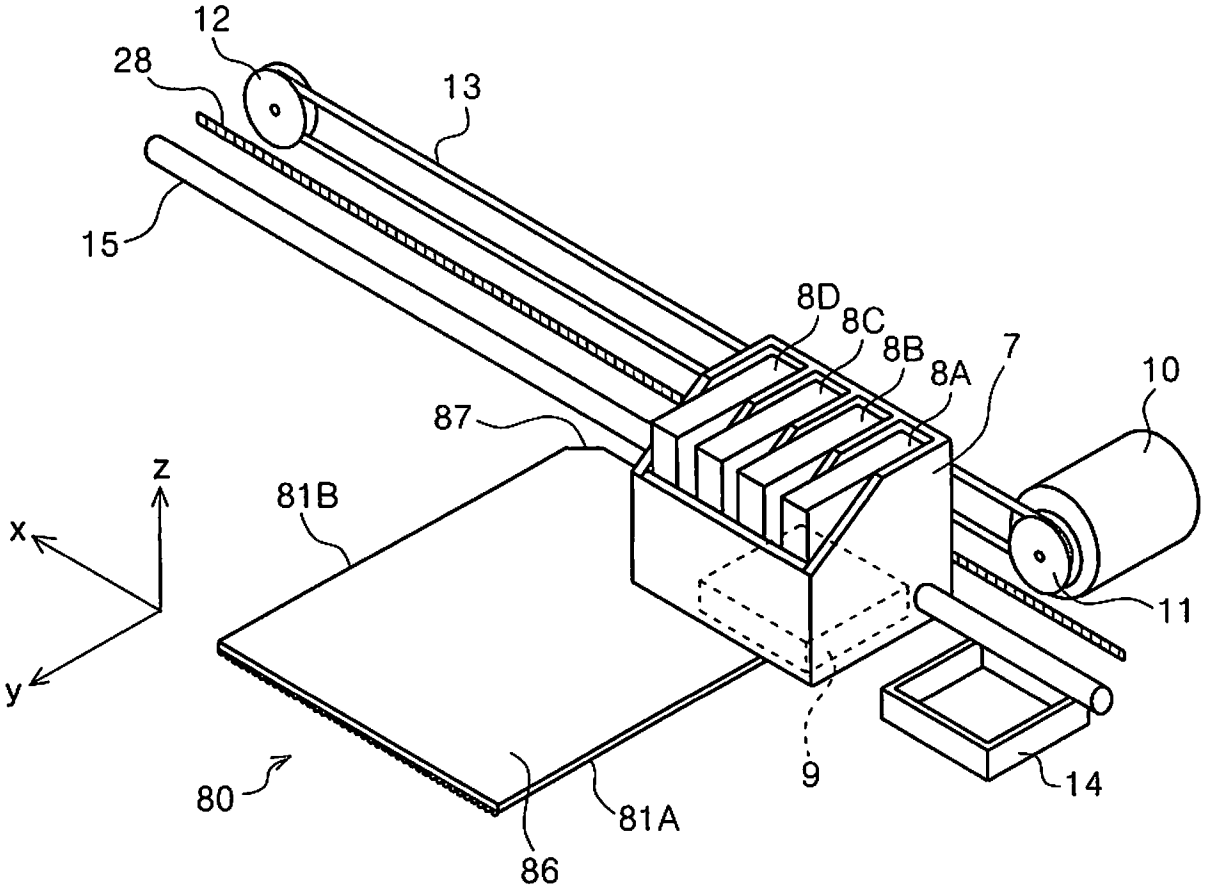
FIG. 5 is a perspective diagram illustrating the configuration of main sections of a printer which performs recording on the lens sheet.
Figure 6A:
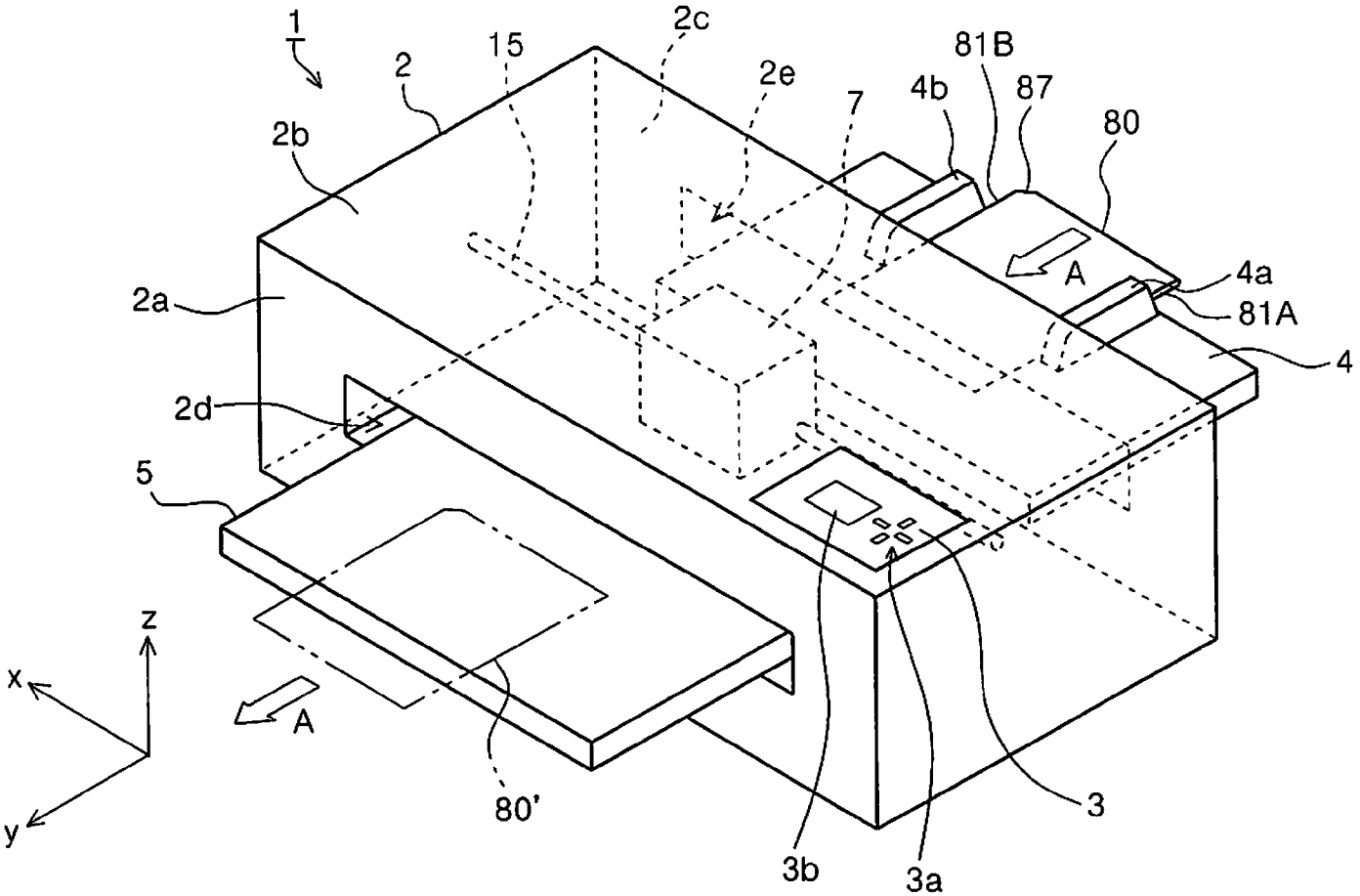
FIG. 6A is a perspective diagram of the outer appearance of the printer.
Figure 6B:
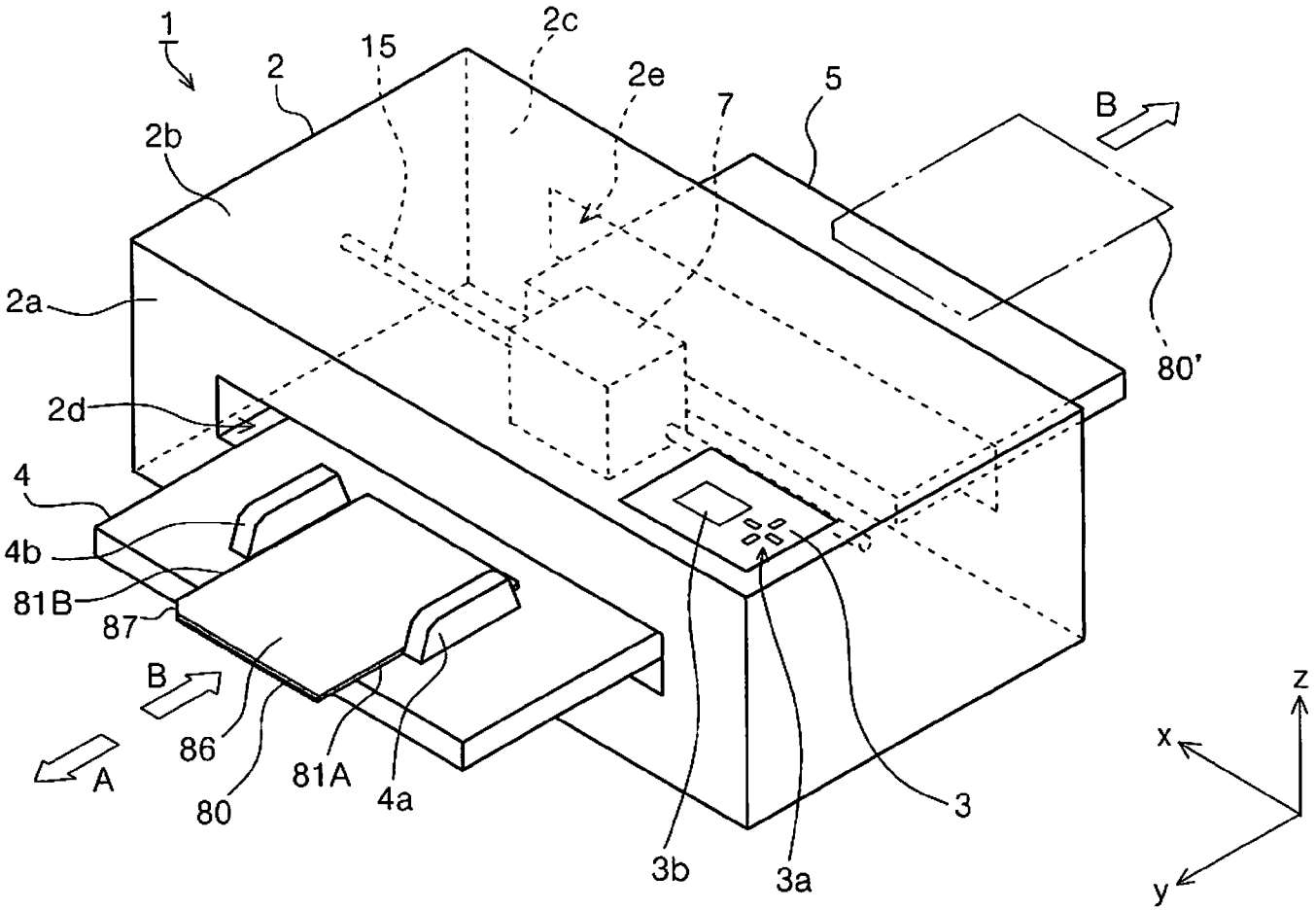
FIG. 6B is the perspective diagram of the outer appearance of the printer.
Figure 6C:
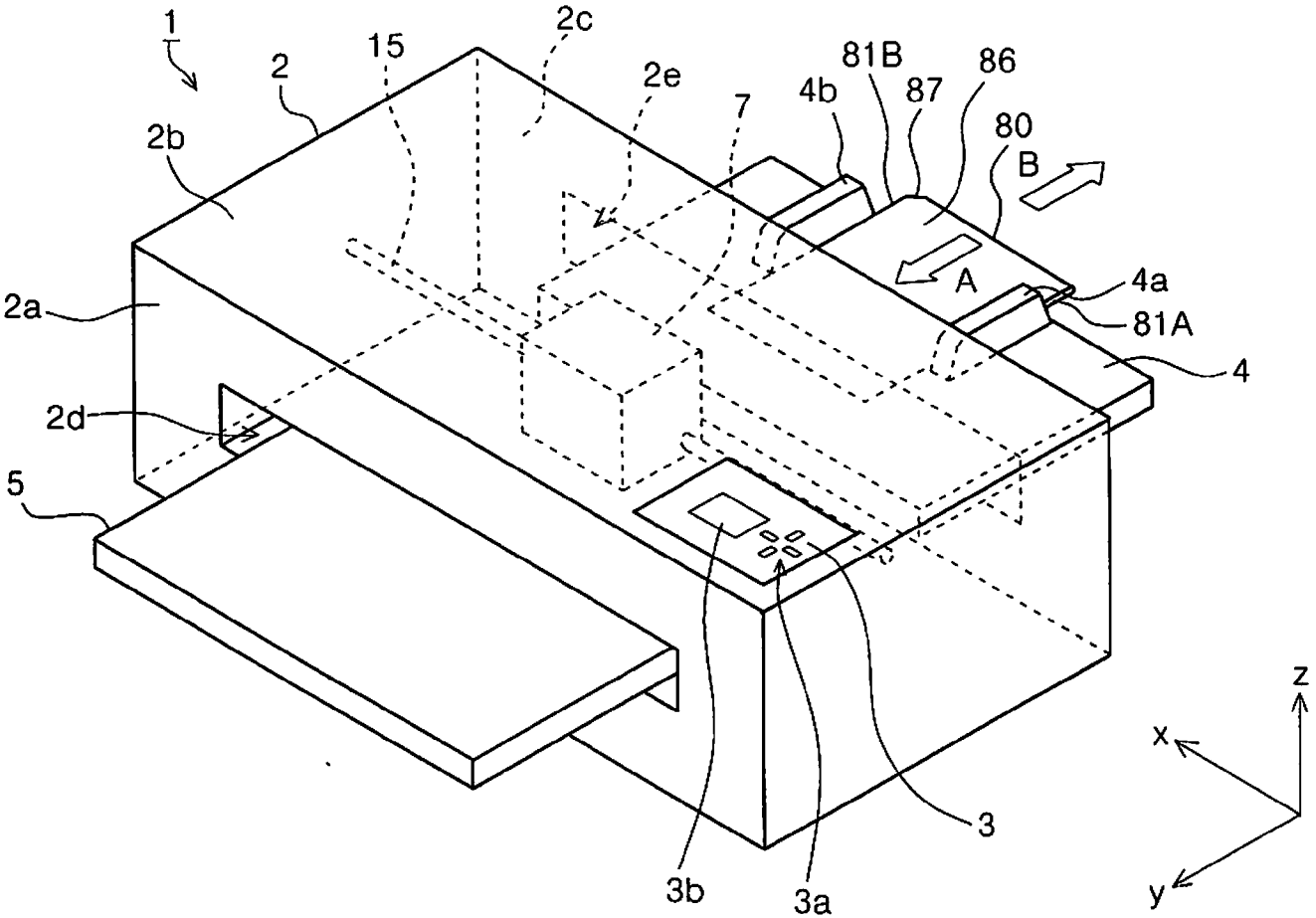
FIG. 6C is the perspective diagram of the outer appearance of the printer.
Figure 7:
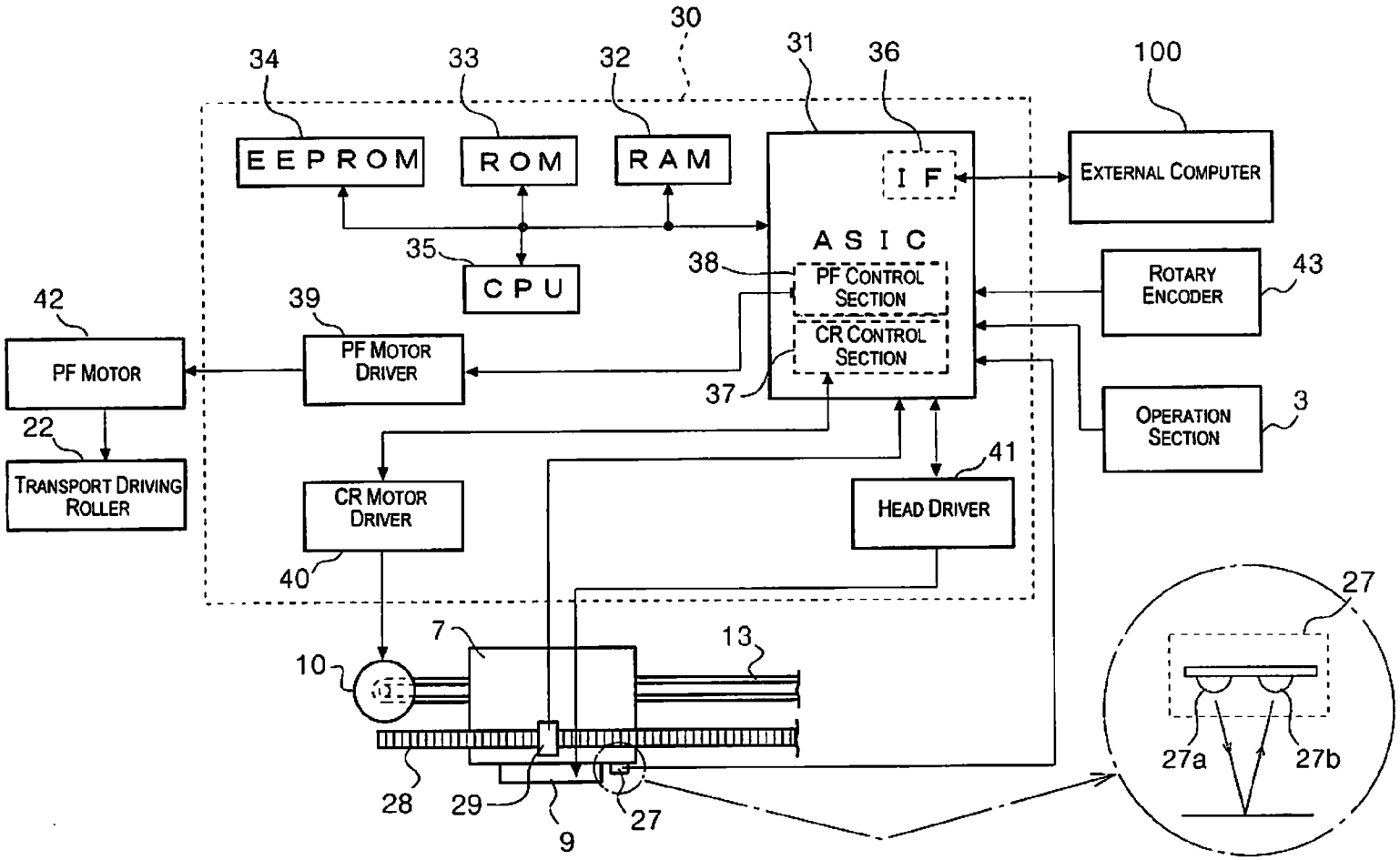
FIG. 7 is a block diagram illustrating a configuration of a controller of the printer.
Figure 8A:
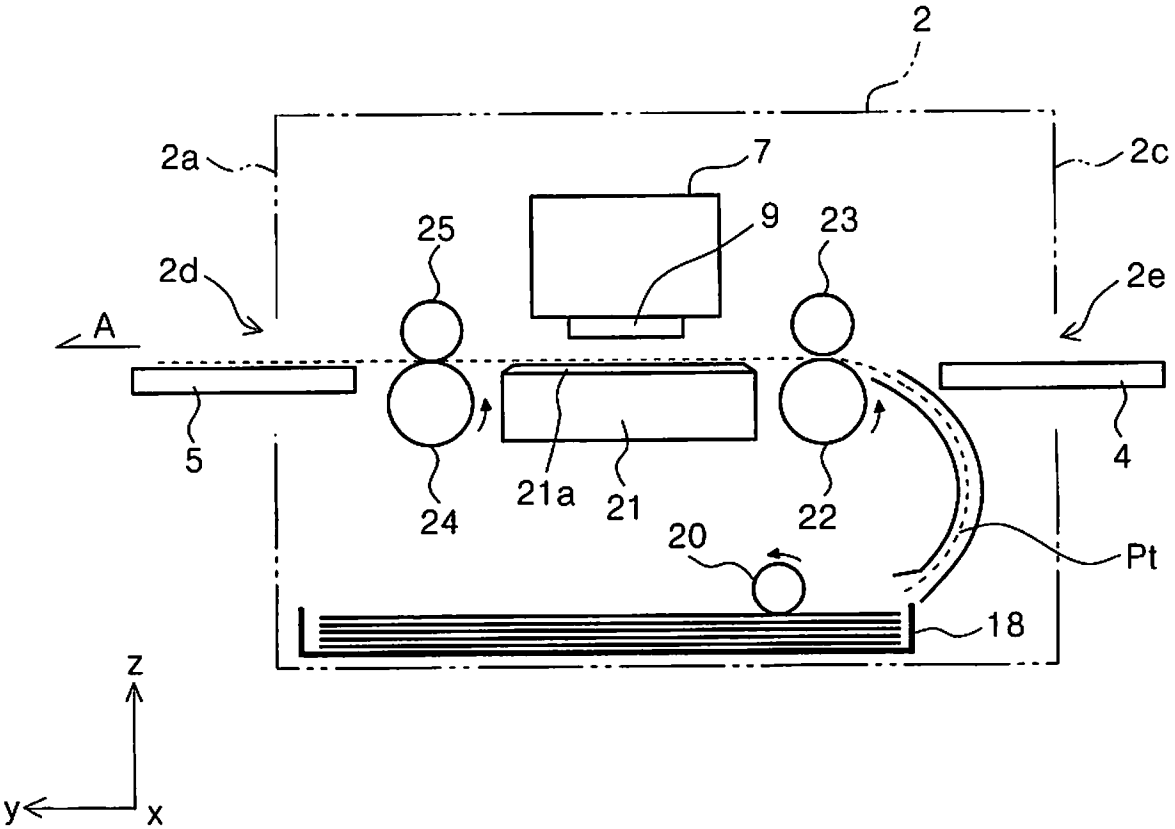
FIG. 8A is a side cross sectional diagram illustrating a medium transport path in the printer.
Figure 8B:
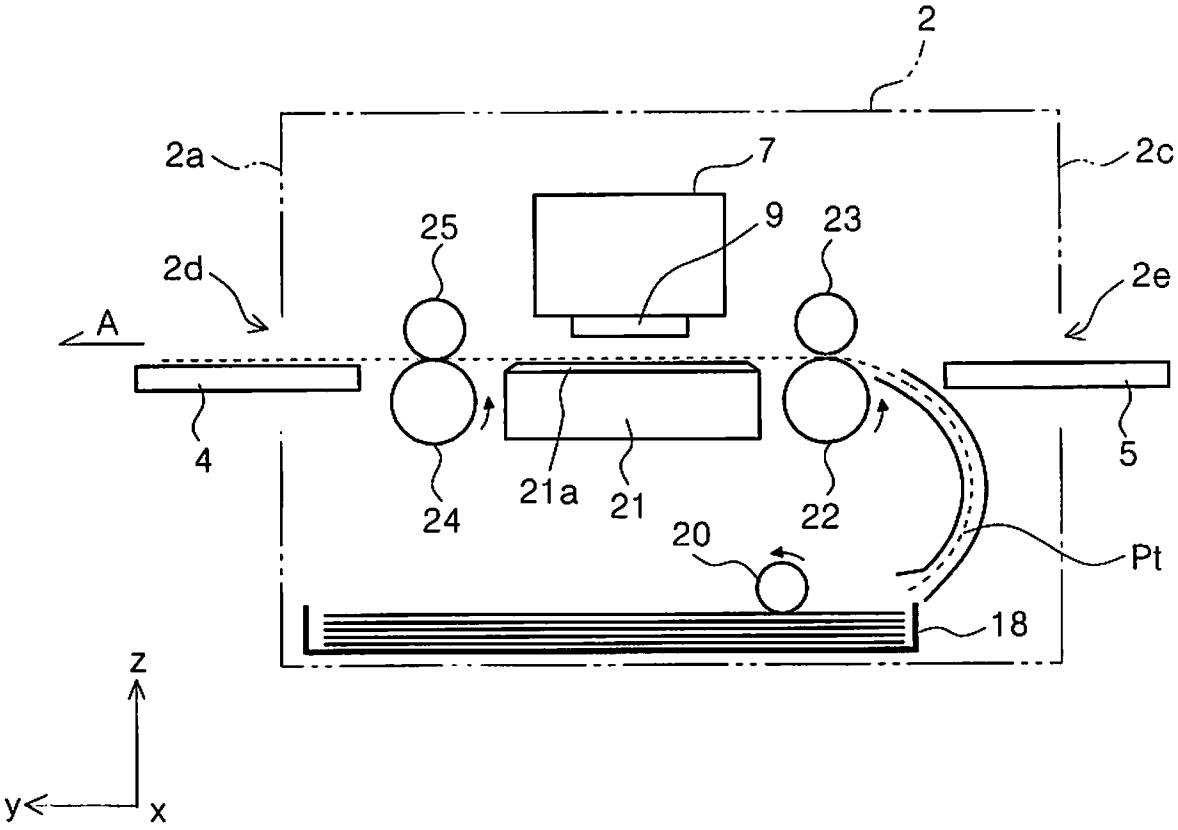
FIG. 8B is the side cross sectional diagram illustrating the medium transport path in the printer.
Figure 8C:
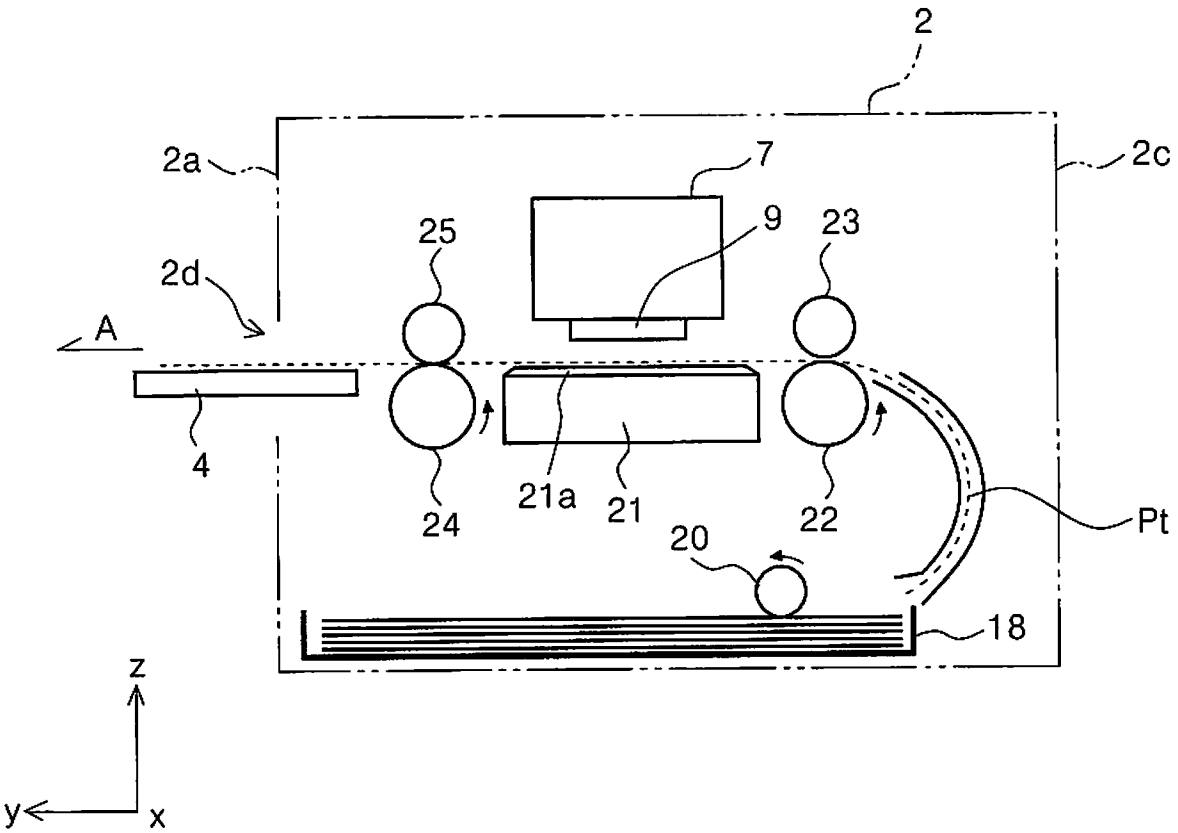
FIG. 8C is the side cross sectional diagram illustrating the medium transport path in the printer.
Figure 9A:
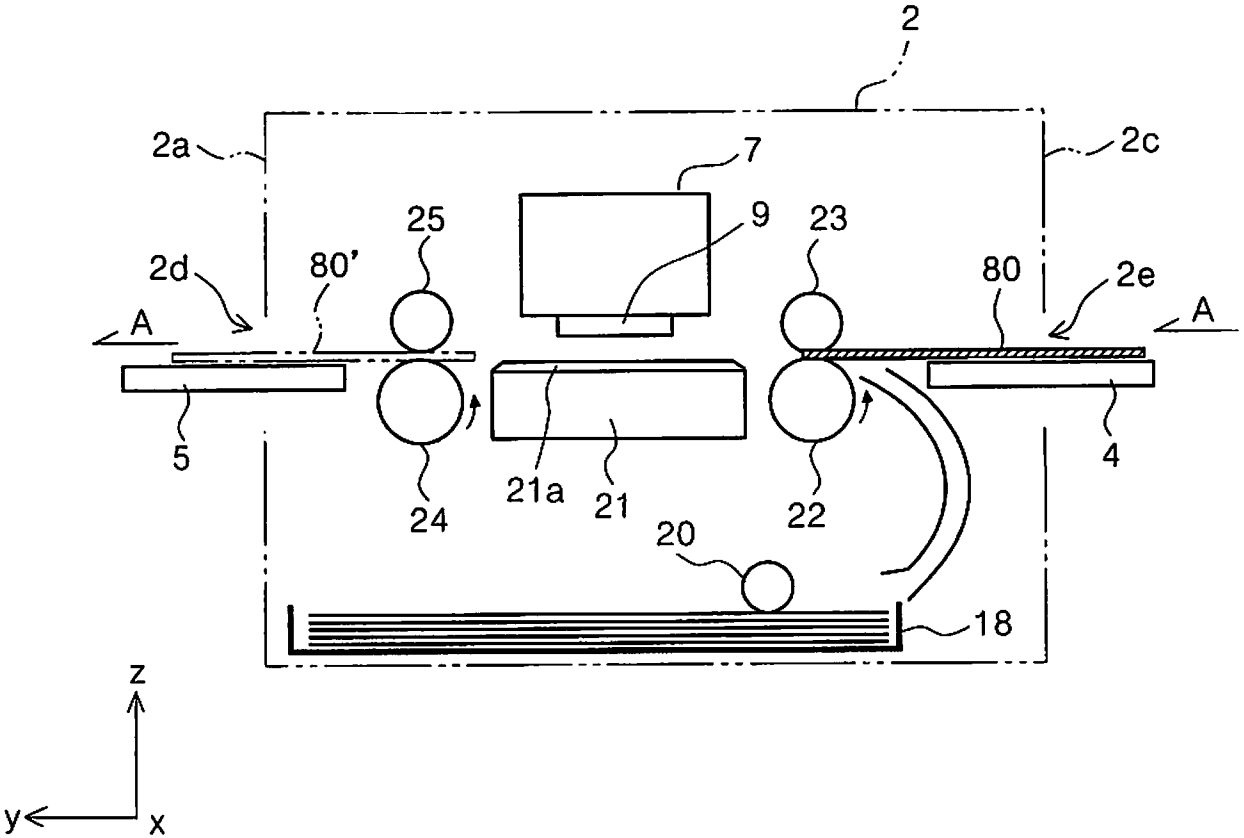
FIG. 9A is a side cross sectional diagram illustrating a transport path in the printer.
Figure 9B:
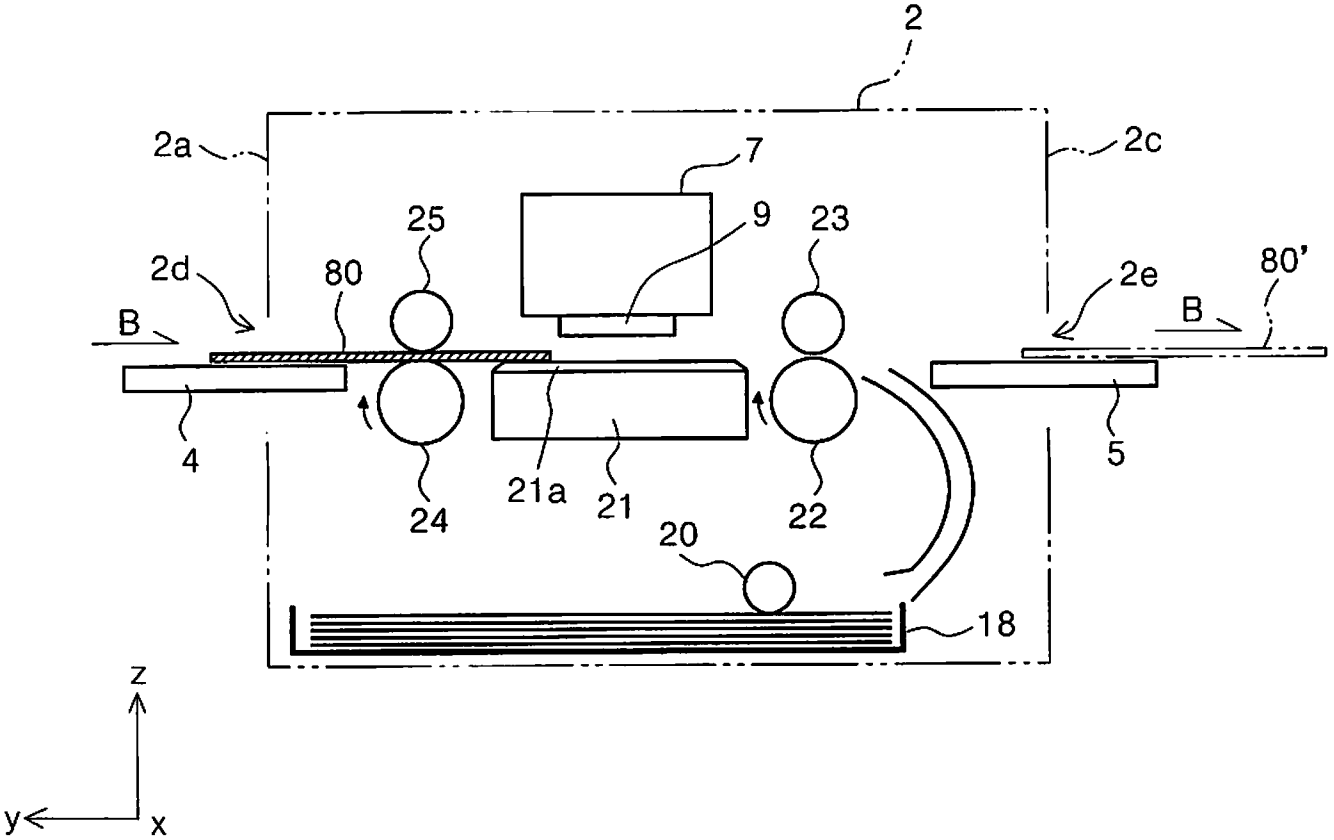
FIG. 9B is the side cross sectional diagram illustrating the transport path in the printer.
Figure 9C:
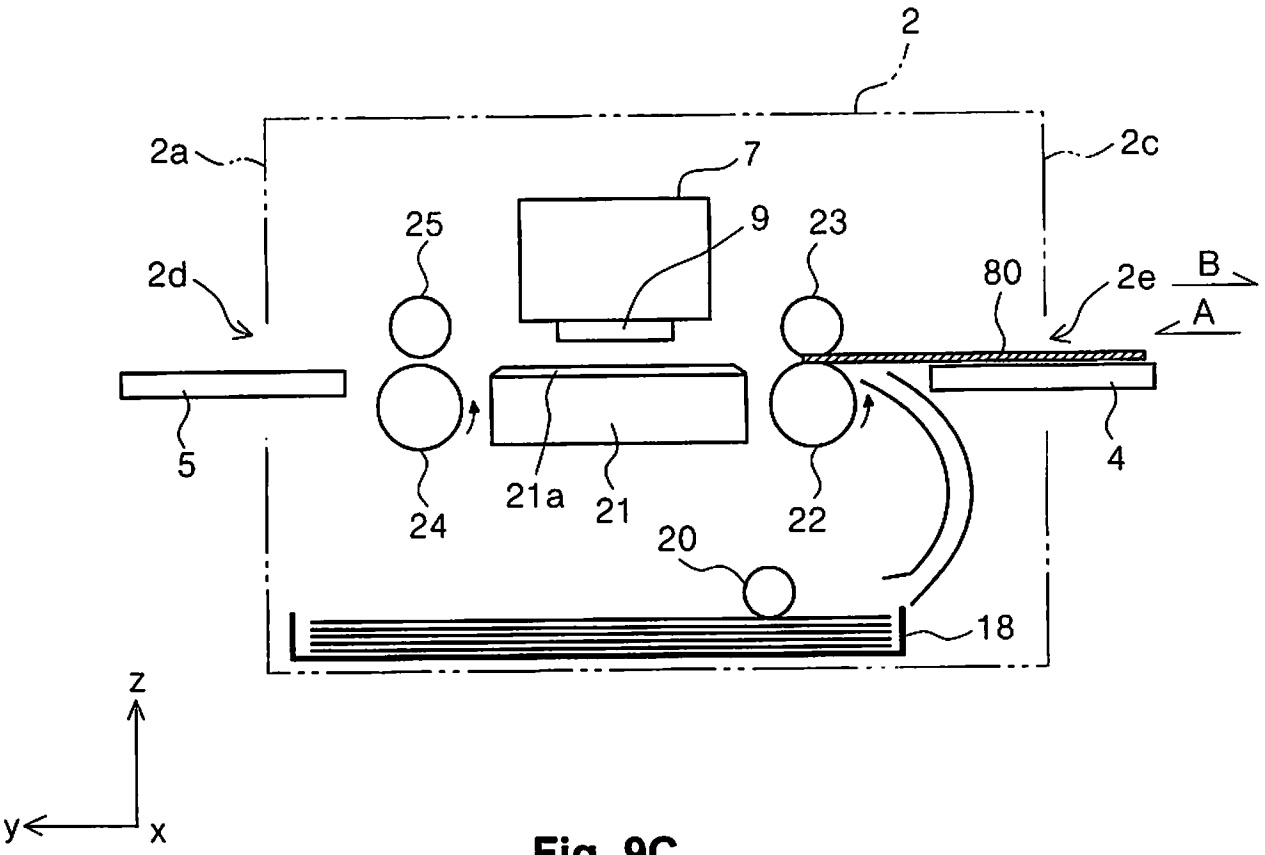
FIG. 9C is the side cross sectional diagram illustrating the transport path in the printer.
Figure 9D:
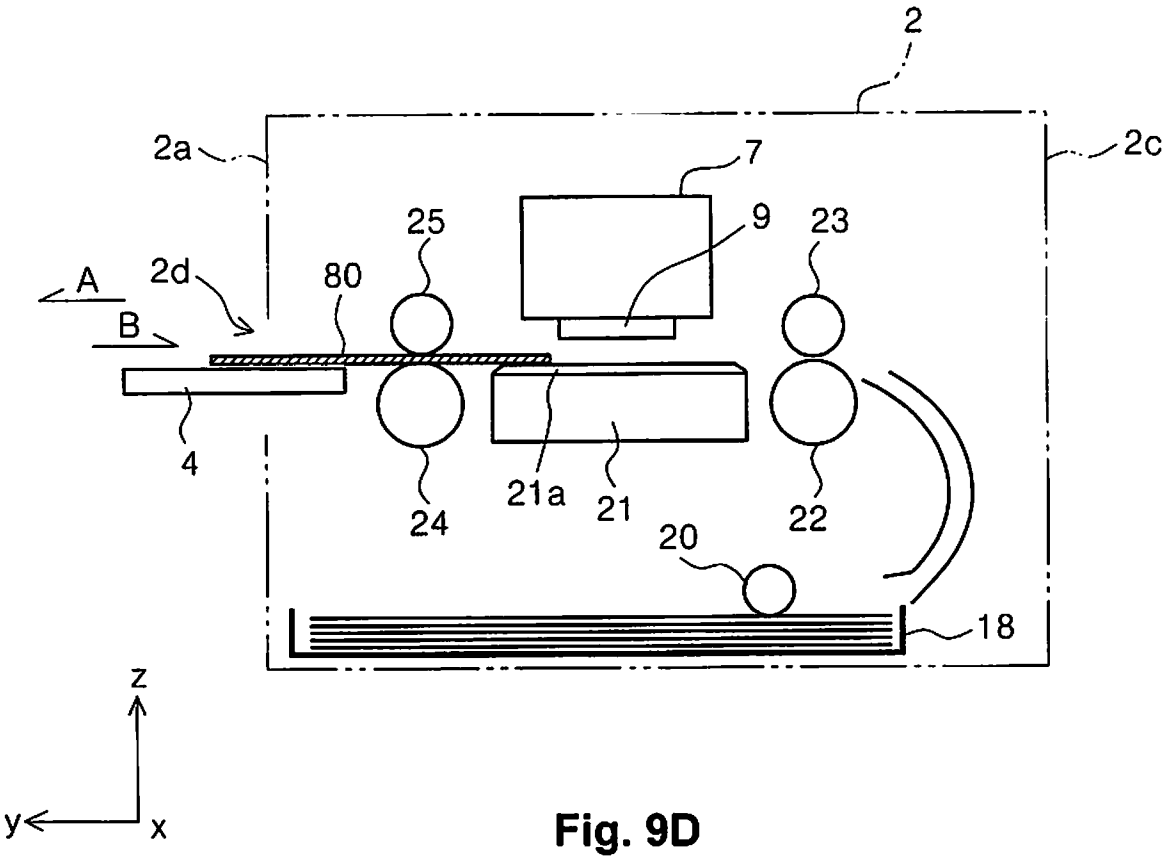
FIG. 9D is the side cross sectional diagram illustrating the transport path in the printer.
Figure 10:
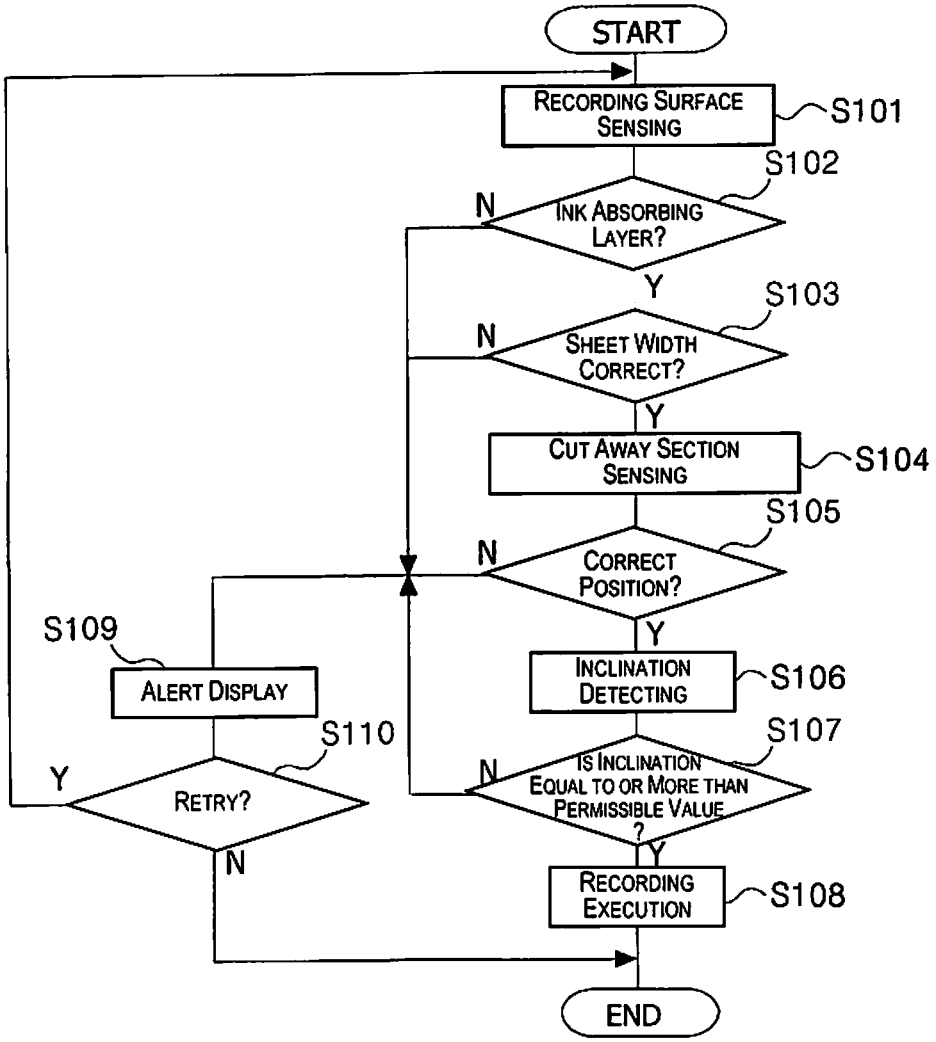
FIG. 10 is a flow chart illustrating control contents during lens sheet recording.
Figure 11:
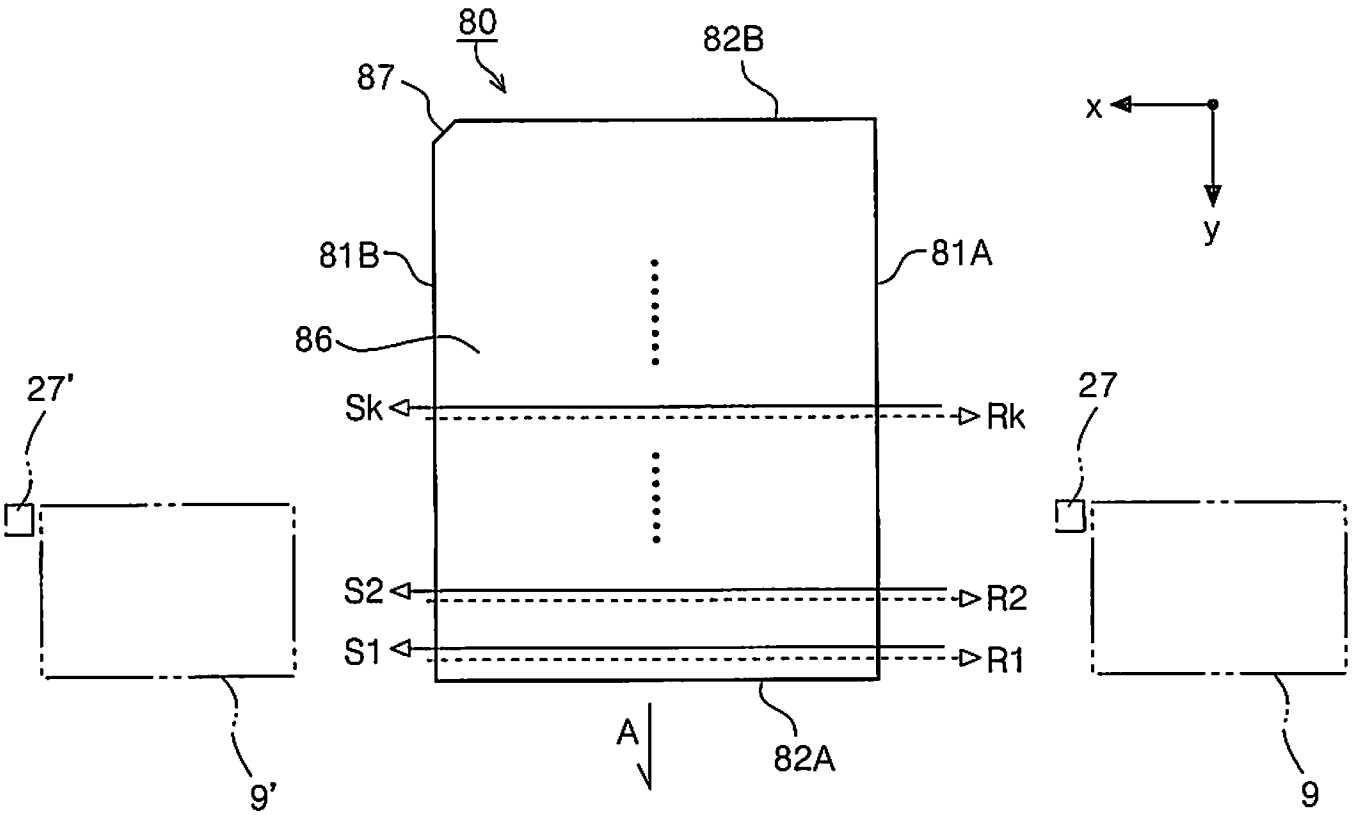
FIG. 11 is a diagram illustrating a positional relationship between the lens sheet, a recording head, and a PW sensor.

FIG. 5 is a perspective diagram illustrating the configuration of main sections of an ink jet printer (referred to below as a "printer") 1 which is an example of a recording apparatus which performs recording on the lens sheet 80, FIGS. 6A to 6C are perspective diagrams of the outer appearance of the printer 1, FIG. 7 is a block diagram illustrating a configuration of a controller 30 of the printer 1, and FIGS. 8A to 8C and FIGS. 9A to 9D are side cross sectional diagrams illustrating a medium transport path in the printer 1. In addition, FIG. 10 is a flow chart illustrating control contents during recording onto the lens sheet 80 and FIG. 11 is a diagram illustrating a positional relationship between the lens sheet 80, a recording head 9, and a PW sensor 27.

Here, in the x-y-z orthogonal coordinate system shown in each of the diagrams, the x direction and the y direction are horizontal directions, where the x direction is the medium width direction (a direction which is orthogonal to a sheet transport direction) during recording and which is also the apparatus left and right direction of the printer 1. In addition, the y direction is the medium transport direction and is also the apparatus depth direction of the printer 1. Furthermore, the z direction is the direction of gravity and is also the apparatus height direction of the printer 1. The x-y-z coordinate system in FIGS. 1A and 1B to FIG. 3 corresponds to the orientation of the lens sheet 80 when the lens sheet 80 is transported inside the printer 1. Here, the x direction is an example of the "second direction" of the present invention and the y direction is an example of the "first direction".

Below, the lens sheet 80 according to the embodiment of the target recording medium of the present invention will be described first in detail with reference to FIGS. 1A and 1B to FIGS. 4A to 4C, and next, the configuration of the printer 1 which is an example of a recording apparatus which performs ink jet recording with regard to the lens sheet 80 will be described along with recording onto the lens sheet 80 using the printer 1 with reference to FIG. 5 and beyond.

1. LENS SHEET

The lens sheet 80 is provided with the lens layer 83, which is a lenticular lens which is formed by arranging a plurality of lenses Gk (where k is an integer of 1 to n), which have a semi-cylindrical cross section and which extend in the y direction, in the x direction and the ink absorbing layer 86, which is a recording layer which configures a surface on the opposite side with regard to the surface which is configured by the lens layer 83.

The lens sheet 80 is formed with an overall shape which is a rectangle and formed in the size of, for example, a postcard. Here, in FIGS. 1A and 1B to FIGS. 4A to 4C, the edge on one side in the x direction is indicated with the reference numeral 81A and the edge on the other side is indicated with the reference numeral 81B. In addition, the edge on one side in the y direction is indicated with the reference numeral 82A, the edge on the other side is indicated with the reference numeral 82B, and each of the sides (the edges) which configure the four sides are distinguished.

An adhesive layer 84 and a base layer 85 are provided as intermediate layers in order from the lens layer 83 toward the ink absorbing layer 86 between the lens layer 83 and the ink absorbing layer 86 in FIG. 2, and each of these layers is laminated by strictly controlling the overall thickness when bonding the layers together (laminating). It is easy to monitor the overall thickness in the laminating system and it is possible to laminate each of the layers even in a case where the lens layer 83 is thick regardless of the thickness of the lens layer 83, compared to a system where sheets are fed out from a roll and the ink absorbing layer is formed on the sheets which are fed out.

The ink droplets which are ejected with regard to the ink absorbing layer 86 and which are an example of a liquid form an image by becoming attached to the ink absorbing layer 86, permeating into the ink absorbing layer 86, and being fixed at a boundary with the base layer 85.

(1) to (8) in FIG. 3 are examples of images which are formed by ejecting ink using the printer 1 which will be described later and images which are different for (1) to (8) are formed with regard to one of the lenses Gk. By forming a plurality of different images with regard to one of the lenses Gk in this manner, parallax is provided between the right eye and the left eye when viewing from the side of the lens layer 83 and a predetermined visual effect such as a 3D effect or a motion effect is generated.

Here, the ink which is ejected with regard to the ink absorbing layer 86 is fixed in the vicinity of the boundary between the ink absorbing layer 86 and the base layer 85 as described above. In order to view this from the side of the lens layer 83, the lens layer 83, the adhesive layer 84, and the base layer 85 are transparent and have substantially the same refractive index.

The reference numeral r in FIG. 3 is the radius of curvature of the lenses Gk and f is the focal point distance. The focal point distance f is given by the following formula A.

$$1/f=[n-1]\times[(1/r)\times(1/R)] \quad \text{(A)}$$

Here, n is the refractive index of the lenses Gk and R is the radius of curvature of the rear surface side (the ink absorbing layer 86 side) of the lens Gk.

Since R is infinite in the present example, it is possible to modify the formula A as in the manner of A' below.

$$f=r/(n-1) \quad \text{(A)'}$$

The reference numeral h4 in FIG. 3 is equivalent to the combined thicknesses of the lens layer 83, the adhesive layer 84, and the base layer 85. The reference numeral h3 is the overall thickness of the lens sheet 80. The thickness h4 in the present example is equivalent to the focal point distance f. That is, since the focal point position is set between the base layer 85 and the ink absorbing layer 86, it is possible to favorably view the image, which is formed by ejecting ink from the side of the ink absorbing layer 86, from the side of the lens layer 83.

As long as the lens layer 83 is provided with the function of a lenticular lens, the material is not limited, but it is possible to use, for example, a resin such as PET, PETG, APET, PP, PS, PVC, acrylic, and UV curable resins.

The ink absorbing layer 86 is not particularly limited as long as it is a composition where it is possible for ink to be absorbed and fixed, but examples include water-absorbing resins such as acrylic-based resins and urethane-based resins.

The base layer 85 gives a moderate rigidity (resilience) with regard to the overall shape of the lens sheet 80 and the material is not limited as long as the light transmittance is high, and it is possible to use, for example, a resin such as PET, PETG, APET, PP, PS, PVC, or acrylic resins.

The material of the adhesive layer 84 is not limited as long as it is possible to favorably adhere the base layer 85 and the lens layer 83 and the light transmittance is high, but double-sided tape with high transparency is used in the present example. The double-sided tape may or may not have a base material and, for example, it is possible to use double-sided tape which is, for example, configured by only an acrylic-based adhesive material.

Here, an ink permeable layer may be provided on the surface of the ink absorbing layer 86. That is, the ink droplets which are ejected by the ink jet recording method may be configured so as to attach to the ink permeable layer and reach the ink absorbing layer 86 by penetrating into the ink permeable layer.

The material of the ink permeable layer is not particularly limited as long as the ink permeable layer has a function of guiding the ink droplets to the ink absorbing layer 86, but a material which has a porous structure with a water-absorbing property is suitable.

In addition, it is possible for the target recording medium to have a white background by one or both of the ink absorbing layer 86 and the ink permeable layer described above being non-transparent.

As a specific example of each of the layers, the lens pitch (a dimension W1 in FIG. 2 and FIG. 3) is 60 lpi (lens per inches). In addition, the thickness of the lens layer 83 is 0.43 mm and the refractive index is 0.1575. In addition, the adhesive layer 84 has a thickness of 0.25 mm. In addition, the base layer 85 has a thickness of 0.10 mm. In addition, the ink absorbing layer 86 has a thickness of 0.025 mm.

Here, the layers, the materials, the thicknesses, the refractive indexes, the shapes of the lenses Gk, the pitch, and the like in the configuration of the lens sheet 80 described above are examples and it is obvious that the present invention is not limited to this.

Subsequently, the edge 81A on one side in the x direction and the edge 81B on the other side are formed asymmetrically in the lens sheet 80. In detail, the edge 81B is partially cutout portion (a portion which is indicated by the reference numeral 87), and due to this, the edge 81A and the edge 81B are formed to have an asymmetric shape. The cutout portion 87 is a mark (an identification mark) and it is possible to easily and reliably perform matching when the end surface on the one side, that is, the end surface which is to be a reference (the edge 81A in the present example) is matched with the correct direction when recording is performed by the printer 1 which will be described later and it is possible to more reliably obtain a favorable recording result as a result.

Here, although, as an example, the cutout portion 87 forms a so-called "C plane shape" so as to form an angle at 45° with regard to the x direction and the y direction, the cutout portion 87 may form an "R plane shape" or various other shapes may be adopted without being limited to this. That is, any shape, position, or size may be used as long as it is possible for a user to identify which side the edge 81A which is a reference is.

Next, the label sheet 90 will be described with reference to FIG. 4A to FIG. 4C. The label sheet 90 is bonded with regard to the ink absorbing layer 86 in order to protect the recording surface of the lens sheet 80, that is, the ink absorbing layer 86.

In more detail, the label sheet 90 has an adhesive layer on the surface on one side of a base material 91 and is in a state where detachable sheets 92 and 93 are attached to the adhesive layer (FIG. 4A).

The detachable sheet 92 is formed to have a length which is shorter than the detachable sheet 93 and the adhesive layer is exposed by first peeling off the detachable sheet 92 with the short length in a case where the label sheet 90 is bonded onto the lens sheet 80. Next, the adhesive layer which is exposed is faced toward the ink absorbing layer 86 of the lens sheet 80, and the edge 82A which is a lower section is put on a flat surface such as a desk in a state of light overlapping without being tightly attached, that is, the label sheet 90 is positionally aligned with regard to the lens sheet 80 with the edge 82A as a reference (FIG. 4B).

Next, the positions of upper section regions of the label sheet 90 and the lens sheet 80 in FIG. 4B are fixed by pinching a region, where the adhesive layer is exposed due to the detachable sheet 92 being peeled off, with fingers and adhering the upper section regions of the label sheet 90 and the lens sheet 80 in FIG. 4B. Next, the remaining adhesive layer is exposed by peeling off the detachable sheet 93 at the lower side in FIG. 4B, pinched with fingers in the same manner as the upper section region which is already bonded together, and the label sheet 90 is completely bonded with regard to the lens sheet 80.

By bonding the label sheet 90 onto the lens sheet 80 in the above manner, it is possible to easily bond the label sheet 90 onto the lens sheet 80 without deviations in position.

Here, a length L2 of the label sheet 90 is formed to be shorter than a length L1 of the lens sheet 80 and a width M2 of the label sheet 90 is formed to be shorter than a width M1 of the lens sheet 80 such that corner sections of the label sheet 90 do not protrude from the cutout portion 87 of the lens sheet 80 when bonded with the lens sheet 80 without any of the four corner sections of the label sheet 90 being cutout portion.

Subsequently, the edge 81A on the one side of the lens sheet 80 in the x direction and the edge 81B of the other side will be described. The thickness of the lens layer 83 at the edge 81A on the one side of the lens sheet 80 in the x direction is represented by the reference numeral h1 in FIG. 2, and the width of the lens G1 which is formed at the edge 81A is represented by the reference numeral w1. In the same manner, the thickness of the lens layer 83 at the edge 81B on the other side is represented by the reference numeral h2 in FIG. 2 and the width of the lens Gn which forms the edge 81B is represented by the reference numeral w2.

Figure 19:
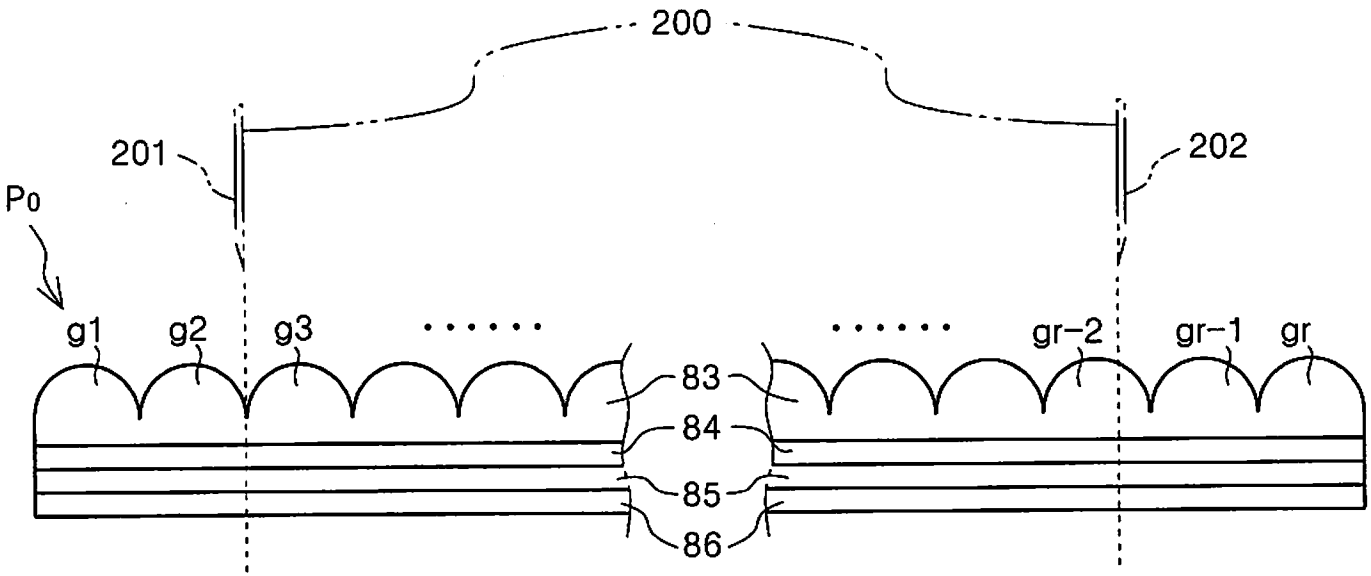
FIG. 19 is a diagram schematically illustrating positional alignment in punching out of the lens sheet.

The overall shape of the cutting apparatus which forms (cuts and punches out) the lens sheet 80 is omitted from the diagrams, but a punching die 200 is shown in FIG. 19 when punching out the lens sheet 80 from a lens sheet PO (a sheet with a size which is larger than the lens sheet 80 and which is the basis of the lens sheet 80). Since the lens sheet 80 according to the present example is a rectangle, the punching die 200 is also a rectangle along the shape of the lens sheet 80 and is configured by four blades so as to form (punch out) the four sides of the lens sheet 80. The reference numerals 201 and 202 are two blades which face each other and which configure the four blades. The other two blades are omitted from the diagram of FIG. 19.

In FIG. 19, the respective lenses are indicated by the reference numerals g1 to gr and the lens sheet 80 after punching out is shown as being configured by the lenses g3 to gr-2. That is, the lens g3 in FIG. 19 is the lens G1 in FIG. 2 and the lens gr-2 in FIG. 19 is the lens Gn in FIG. 2.

In a punching out process as shown in FIG. 19, the blade 201 is positionally aligned in the x direction in FIG. 19 and punched through between the lens g2 and the lens g3 which are adjacent.

That is, the cutting surface when cutting is performed is the edge 81A in FIG. 2 by carrying out strict monitoring such that the cutting blade (the blade 201 in FIG. 19) enters into a position precisely in the valley of the adjacent lenses gk in the present invention. The edge 81B on the other side in FIG. 2 is a slicing surface when cutting is carried out without closely monitoring the cutting position (without performing positional alignment of the cutting blade).

Accordingly, the thickness h1 of the lens layer 83 at the edge 81A is thinner than the thickness h2 of the lens layer 83 at the edge 81B. Here, the thickness of the overall shape of the edge 81A is thinner than the thickness of the overall shape of the edge 81B since the thicknesses of each of the layers other than the lens layer 83 are uniform.

In addition, the width w1 of the lens G1 which is formed at the edge 81A is wider than the width w2 of the lens Gn which is formed at the edge 81B on the other side, and the width w1 of the lens G1 is equivalent to the width (w1) of the lens G2 which is adjacent to the lens G1. Here, the width of the lenses Gk other than the lenses at the end sections is w1.

That is, it is sufficient if the cutting position is strictly monitored when forming the edge 81A on the one side, and it is not necessary to closely monitor the cutting position when forming the edge 81B on the other side. Accordingly, it is possible to suppress increases in complexity and cost of the cutting apparatus and it is possible to prevent increases in the cost of the lens sheet 80.

Then, when recording is performed on the lens sheet 80 with the edge 81A which is formed by being strictly sliced as a reference, it is possible to prevent an image which is to be recorded on one of the lenses Gk from being recorded across another lens which is adjacent. That is, it is possible to exactly fit the images of (1) to (8) entirely in the lens G1 in the example in FIG. 3 and it is possible to obtain a favorable visual effect.

Here, ink jet recording onto the lens sheet 80 will be described in detail later.

The lens sheet 80 as described above is provided with the lens layer 83 which is formed by arranging the lenses Gk, which extend in the y direction as the first direction, in a plurality of lines in the x direction as the second direction which is a direction which is orthogonal to the first direction, and the ink absorbing layer 86 which configures a surface on the opposite side with regard to a surface which is configured by the lens layer 83, where the width of a lens (G1) which is formed at the edge 81A which is the end surface on one side of the lens layer 83 in the x direction is equivalent to the width (W1) of a lens (G2) which is adjacent to the lens (G1) which is formed at the end surface on the one side.

In other words, the thickness of the edge 81A which is the end surface on the one side is thinner than the thickness of the edge 81B which is the end surface on the other side. Furthermore, in other words, the width W1 of the lens G1 which is formed at the edge 81A is wider than the width W2 of the lens Gn which is formed at the edge 81B.

Here, "the width of the lens G1 which is formed at the edge 81A is equivalent to the width of the lens G2 which is adjacent" does not have the meaning only that the width of the lens G1 and the width of the lens G2 are always completely the same, but includes some degree of error in the dimensions and has the meaning that the width of the lens G1 and the width of the lens G2 are substantially the same.

Due to this, when forming the lens sheet 80, it is sufficient if the cutting position when forming the edge 81A on the one side is strictly monitored, it is not necessary to closely monitor the cutting position when forming the edge 81B on the other side and it is possible to prevent large increases in the cost of the lens sheet 80.

Here, as a feature where it is possible to arbitrarily add to the features of the lens sheet 80 according to the present embodiment, it is possible for the lens sheet 80 to be formed such that the overall shape of the lens sheet 80 forms a rectangle and the edge on the one side and the edge on the other side in the x direction or the y direction are formed with an asymmetric shape. That is, in order to identify the edge 81A which is a reference, the cutout portion 87 is formed in the example described above and the edge 81A and the edge 81B are formed so as to form an asymmetric form.

Due to this, it is possible to easily and reliably perform matching when the edge 81A which is to be a reference is matched with the correct direction when performing recording on the lens sheet 80 (when the lens sheet 80 is set on a tray 4), and it is possible to more reliably obtain a favorable recording result as a result.

In addition, it is possible to provide the adhesive layer 84, which adheres to the lens layer 83 and the ink absorbing layer 86, between the lens layer 83 and the ink absorbing layer 86.

In addition, it is possible for the base layer 85 to be provided between the adhesive layer 84 and the ink absorbing layer 86.

In addition, it is possible for the focal point distance f with regard to incident light from the lens layer 83 side to be equivalent to the combined thickness h4 of the lens layer 83, the adhesive layer 84, and the base layer 85. Due to this, it is possible to easily view the image, which is formed by ejecting ink from the side of the ink absorbing layer 86, from the side of the lens layer 83.

2. PRINTER CONFIGURATION AND RECORDING ONTO LENS SHEET

Below, the configuration of the printer 1 and the recording onto the lens sheet 80 will be described in detail with reference to FIG. 5 and beyond.

Printer Configuration

The printer 1 according to the present embodiment performs recording with regard to a plurality of types of target recording media. In the present example, recording is performed with regard to a single sheet of paper such as normal paper or specialized paper as a "first target recording medium" which does not have the lenses described above and to the lens sheet 80 as a "second target recording medium". Here, the "first target recording medium" described above is referred to below as a "sheet P" as appropriate. In addition, in a case where it is not particularly necessary to distinguish between the lens sheet 80 and the sheet P, these will be referred to generically as the "medium" as appropriate.

The reference numeral 9 in FIG. 5 indicates an ink jet recording head (below, "recording head") which ejects ink as an example of a liquid with regard to the medium. The recording head 9 is provided in a bottom section of a carriage 7 and the carriage 7 moves back and forth in the x direction while being guided by a carriage guiding shaft 15 which extends in the x direction.

The carriage 7 is provided with ink cartridges 8A, 8B, 8C, and 8D which are able to be freely attached and detached and ink is supplied to the recording head 9 from each of the ink cartridges 8A to 8D. The ink cartridges 8A to 8D correspond to inks of different colors, for example, each color of magenta, cyan, yellow, and black.

The reference numeral 10 is a motor (referred to below as "CR motor") which is a driving source of the carriage 7 and the reference numeral 11 indicates a driving pulley which is attached to a driving shaft of the CR motor 10. The reference numeral 12 indicates a driven pulley which is able to be driven and rotate and an endless belt 13 is wound around the driving pulley 11 and the driven pulley 12. The carriage 7 is fixed to a portion of the endless belt 13, and due to this, the endless belt 13 is operated and the carriage 7 moves in the x direction when the driving shaft of the CR motor 10 rotates.

The reference numeral 14 is a cap, the cap 14 caps the recording head 9 by the carriage 7 being moved to the upper section of the cap 14, and drying of the nozzle opening (which is not shown in the diagram) which ejects ink is prevented or maintenance such as ink suction from the nozzle opening is performed. Here, the side (the x side) in the printer 1 where the cap 14 is provided in the back and forth movement region of the carriage 7 is the home position side.

The reference numeral 28 is a linear scale and this will be described later.

Next, the outer appearance of the apparatus which is the printer 1 as shown in FIG. 6A to FIG. 6C is configured by a housing 2. The reference numeral 2*a* indicates a front surface (below "apparatus front surface") out of the surfaces which configure the surroundings of the housing 2, the reference numeral 2*b* indicates an upper surface (below "apparatus upper surface"), and the reference numeral 2*c* indicates a rear surface (below, "apparatus rear surface").

An operation unit 3 is provided on the apparatus upper surface 2*b* at a position which is close to the apparatus front surface 2*a* in the apparatus depth direction and at a position on the right side when viewed from the front side of the apparatus. The operation unit 3 is formed by providing operation buttons 3*a* which consist of a power button, various types of print setting buttons, and the like, and a display section 3*b* which shows various types of contents such as setting contents and the state of the apparatus.

A sheet discharge opening 2*d* is formed as a "discharge section" on the apparatus front surface and the sheet P where recording is performed is discharged from the sheet discharge opening 2*d*. An opening section 2*e* is formed on the apparatus rear surface 2*c* and the lens sheet 80 is fed via the opening section 2*e*. The arrow A in FIG. 6A, FIG. 8A, and FIG. 9A is in a direction (the first direction) from the apparatus rear surface 2*c* toward the apparatus front surface 2*a*. The reference numeral 5 indicates a tray which receives the sheet P or the lens sheet 80 which is discharged in the A direction by recording being performed.

As another embodiment, the sheet discharge opening 2*d* is formed as a "first discharge section" on the front surface of the apparatus and the sheet P where recording is performed is discharged from the sheet discharge opening 2*d*. A lens sheet discharge opening 2*e* is formed as the "second discharge section" on the apparatus rear surface 2*c* and the lens sheet 80 where recording is performed is discharged from the lens sheet discharge opening 2*e*. In FIG. 6B, FIG. 8B, and FIG. 9B, the arrow A is in a direction (the first direction) from the apparatus rear surface 2*c* toward the apparatus front surface 2*a* and the arrow B is the opposite direction, that is, from the apparatus front surface 2*a* toward the apparatus rear surface 2*c*.

As yet another embodiment, the sheet discharge opening 2*d* is formed as the "first discharge section" on the front surface of the apparatus and the sheet P where recording is performed is discharged from the sheet discharge opening 2*d*. An opening section 2*e* is formed as the "second discharge section" on the apparatus rear surface 2*c* and the lens sheet 80 is fed and ejected via the opening section 2*e*. In FIG. 6C, FIG. 8A, and FIG. 9C the arrow A is in a direction from the apparatus rear surface 2*c* toward the apparatus front surface 2*a* and the arrow B is the opposite direction, that is, from the apparatus front surface 2*a* toward the apparatus rear surface 2*c*. The reference numeral 5 indicates a tray which receives the sheet P which is discharged in the A direction after recording is performed.

As yet another embodiment, the sheet discharge opening 2*d* is formed as a "discharge section" on the apparatus front surface and the sheet P and the lens sheet 80 is discharged from the sheet discharge opening 2*d*. An opening section is not formed in the apparatus rear surface 2*c*. In FIG. 6B, FIG. 8C, and FIG. 9D, the arrow A is in a direction from the apparatus rear surface 2*c* toward the apparatus front surface 2*a* and the arrow B is the opposite direction, that is, from the apparatus front surface 2*a* toward the apparatus rear surface 2*c*.

The reference numeral 4 is a tray which functions as a "holding section" where the lens sheet 80 is held before the start of recording. The tray 4 is a tray which is provided horizontally in the present example. Edge guides 4*a* and 4*b* are provided in the tray 4 to be spaced at predetermined intervals in the x direction.

In the present example, the medium is fed and transported with the center in the width direction as a reference. The edge guides 4*a* and 4*b* are provided to slide in synchronization in the width direction of the medium (the x direction) by matching the size of the medium. In addition, each of the rollers which will be described later and which transport the medium is arranged symmetrically to the left and right with the center in the width direction as a reference and roller load is applied equally to the left and right with regard to the center in the width direction of the medium and it is possible to prevent skew due to this.

Next, in the present example, the sheet P is fed from a sheet cassette 18 which will be described later, recording is performed on the sheet P, and the sheet P is discharged in the A direction toward the tray 5 and is supported by the tray 5. The tray 5 is a tray which is provided horizontally in the present example. The lens sheet 80 is sent out from the tray 4 on the apparatus rear surface 2*c* side in the A direction, recording is performed on the lens sheet 80, and the lens sheet 80 is discharged in the A direction toward the tray 5 which is provided on the apparatus front surface 2*a* side and is supported by the tray 5 (reference numeral 80').

Here, the edge guides 4*a* and 4*b* which are provided in the tray 4 guide the edges of the lens sheet 80 exclusively before recording in the present example, but the sheet P or the like with a thickness with little flexibility (which does not bend easily) may be sent out from the tray 4 on the apparatus rear surface 2*c* side in the A direction, recording may be performed on the sheet P, and the sheet P may be discharged in the A direction toward the tray 5 on the apparatus front surface 2*a* side in the same manner as the lens sheet 80.

Subsequently, a medium transport path in the printer 1 will be described with reference to FIG. 8A and FIG. 9A. The sheet cassette 18 which accommodates the sheet P is provided in a bottom section of the apparatus. A feeding roller 20 is provided to be able to advance and retract with regard to the sheet P which is accommodated in the sheet cassette 18, the sheet P is sent out in the direction of the apparatus rear surface side due to the rotation of the feeding roller 20, and the sheet P reaches a first driving roller 22 and a first driven roller 23 which configure the medium transport means by being curved and inverted. A dashed line Pt in FIG. 8A indicates the transport trajectory of the sheet P.

The sheet P is transported to a position (a recording region) which faces the recording head 9 by being nipped by the first driving roller 22 which is driven to rotate and the first driven roller 23 which is rotated by being driven. The reference numeral 21 is a support member which supports the medium. In addition, the reference numerals 21*a* are ribs which are formed on the support member 21 and which support the medium. A plurality of the ribs 21*a* are provided to extend in the y direction and to be spaced at appropriate intervals in the x direction.

A second driving roller 24 and a second driven roller 25, which transport the sheet P where recording is performed toward the tray 4 and which configure a medium transport means, are provided on the apparatus front surface 2*a* side with regard to the recording head 9. The sheet P is discharged in the A direction toward the tray 5 by being nipped by the second driving roller 24 which is driven to rotate and the second driven roller 25 which is rotated by being driven.

On the other hand, the lens sheet 80 is sent from the tray 4 as shown in FIG. 9A to a position which faces the recording head 9 by being nipped by the first driving roller 22 and the first driven roller 23 which is rotated by being driven, and recording is performed. Then, the lens sheet 80 is discharged in the A direction toward the tray 5 as shown by the reference numeral 80' by being nipped by the second driving roller 24 and the second driven roller 25.

As described above, in the printer 1, the lens sheet 80 is transported from the tray 4 which is a holding section to a region (a recording region) which faces the recording head 9, recording is performed on the lens sheet 80, and the lens sheet 80 is discharged toward the tray 5. Here, the transport direction of the lens sheet 80 when recording is performed may be the A direction in FIG. 9A or may be the opposite direction.

When recording is performed on the front end of the lens sheet 80 in a case where the transport direction of the lens sheet 80 when recording is performed is the A direction, the lens sheet 80 is nipped by the first driving roller 22 and the first driven roller 23 without being nipped by the second driving roller 24 and the second driven roller 25. Then, when recording is performed on the rear end of the lens sheet 80, the lens sheet 80 is nipped by the second driving roller 24 and the second driven roller 25 without being nipped by the first driving roller 22 and the first driven roller 23.

Here, when the rear end of the lens sheet 80 is separated from between the first driving roller 22 and the first driven roller 23 in a case where the transport direction of the lens sheet 80 when recording is performed is the A direction, there are cases where a phenomenon (kicking) where the transport amount is temporarily increased by the rear end of the sheet being pushed out from between both of the rollers is generated and the recording quality decreases. However, since the direction in which the lenses Gk of the lens sheet 80 extend and the sheet transport direction are parallel, there is no effect with regard to the position alignment of the respective images (1) to (8) on each of the lenses Gk in FIG. 3 and it is possible to obtain a favorable recording result even when kicking is generated.

Next, the controller 30 as a control unit which performs various types of control and the peripheral configuration of the controller 30 will be described with reference to FIG. 7. A linear sensor 29 which configures a means which detects the carriage speed is provided on the rear surface side of the carriage 7. The linear sensor 29 is formed by being provided with a light emitting section (which is not shown in the diagram) and a light receiving section (which is not shown in the diagram) and is provided such that the linear scale 28 (refer also to FIG. 5) which extends along the x direction is interposed between the light emitting section and the light receiving section. In accordance with movement of the carriage 7, the linear sensor 29 transmits a rectangular wave signal, which accompanies the passage through numerous slits which are formed in the linear scale 28, to the controller 30 and it is possible for the controller 30 to register the position and the speed of the carriage 7 in the x direction due to this.

Next, the first driving roller 22, the second driving roller 24, and the feeding roller 20 described above are driven by a PF motor 42. Out of these, at least one out of the driving target which is driven to rotate by the PF motor 42, that is, the rollers described above or a gear, a pulley, or the like which transfers power with regard to the rollers described above is provided with a rotary scale (which is not shown in the diagram) with a disk shape which configures a rotation detecting means and the rotary scale is read by a rotary encoder 43. Here, the reference numeral 39 is a PF motor driver which controls the PF motor 42.

In accordance with rotation of the PF motor 42, the rotary encoder 43 transmits a rectangular wave signal, which accompanies the passage through the numerous slits which are formed in the rotary scale, to the controller 30 and it is possible for the controller 30 to register the amount of rotation and the rotation speed of various types of driving targets which are driven by the PF motor 42 due to this.

The PW sensor 27 is provided as a means which detects the medium on a lower surface of the carriage 7, that is, the surface which is able to face the medium. The PW sensor 27 is provided with a light emitting section 27*a* which emits light with regard to the medium and a light receiving section 27*b* which receives reflected light from the medium as shown in the enlarged diagram of FIG. 7.

Since the PW sensor 27 faces the support member 21 and the reflectivity of an upper surface of the support member 21 and the medium is different, it is possible for the controller 30 to register the presence or absence of the medium, the edge (the y direction edge and the x direction edge) positions of the medium, the reflectivity of the medium surface, and the like when a signal which indicates the intensity of the received light of the light receiving section 27*b* is sent out to the controller 30.

Subsequently, a RAM 32, a ROM 33, an ASIC 31, a CPU 35, and an EEPROM (a non-volatile memory) 34 are connected with the system bus of the controller 30. Output signals from the rotary encoder 43, the linear encoder 29, the operation unit 3, and the like are input into the CPU 35 via the ASIC 31. The CPU 35 performs a calculation process for executing recording control of the printer 1 and other necessary calculation processes based on the output signals or the like of each of the sensors or the switches.

Recording control programs (firmware) and the like which are necessary for controlling of the printer 1 by the CPU 35 are stored in the ROM 33 and various types of data and the like which are necessary for the processes of the recording control program are stored in the EEPROM 34. The RAM 32 is used as an operation region for the CPU 35 or a temporary storage region for recorded data or the like.

The ASIC 31 has a control circuit for performing rotation control of the PF motor 42 and the CR motor 10 which are DC motors and driving control of the recording head 9. The reference numeral 37 is a CR control unit which performs rotation control of the CR motor 10 and the CR control unit 37 calculates the present speed of the carriage 7 based on the pulse signal (the pulse cycle) which is output from the linear encoder 29 and carries out PID control (feedback control) of driving of the CR motor 10 every time a short period of time elapses (a control step which is also referred to as a PID control cycle) such that the speed of the carriage 7 follows a speed profile which is determined in advance. Here, the reference numeral 40 is a CR motor driver which controls the CR motor 10.

In the same manner, a PF control unit 38 also calculates the present rotation speed of each of the driving targets (a value which is proportional to the amount of rotation) based on the pulse signal (the pulse cycle) which is output from the rotary encoder 43 and carries out PID control (feedback control) of driving of the PF motor 42 such that the speed of each of the driving targets follows a speed profile which is determined in advance.

In addition, the ASIC 31 carries out driving control of the recording head 9 by calculating and generating a control signal for the recording head 9 based on the recorded data, which is sent out from the CPU 35, and the like and sending out the control signal to a head driver 41. Furthermore, the ASIC 31 has an IF 36 which realizes information transfer with an external computer 100 or the like as an information processing apparatus.

Control During Lens Sheet Recording

The above is the configuration of the printer 1 and controlling when recording is performed on the lens sheet 80 will be described next with reference to FIG. 10 and other diagrams.

When the execution of recording is instructed due to an operation by a user in a state where the lens sheet 80 is held on the tray 4 and the front end of the sheet is inserted by a predetermined amount between the first driving roller 22 and the first driven roller 23, the lens sheet 80 is sent to a position which faces the recording head 9.

Next, sensing is carried out by the PW sensor 27 so as to cut across the entirety of the lens sheet 80 in the width direction (the x direction) (step S101). Due to this sensing, it is first determined whether or not the upper surface which faces the recording head 9 is the ink absorbing layer 86 using the reflected light from the lens sheet 80. As a result, in a case where the upper surface is not the ink absorbing layer 86 (No in step S102), an alert is displayed on the display section 3*b* (step S109) and the user is prompted to invert the front and back of the lens sheet 80. Here, the intensity of the reflected light is higher for the lens layer 83 compared to the ink absorbing layer 86.

Next, in a case where it is possible to determine that the upper surface which faces the recording head 9 in the lens sheet 80 is the ink absorbing layer 86 (Yes in step S102), it is determined whether or not the sheet width which is obtained by the sensing is correct (step S103). That is, it is determined whether the orientation of the setting of the lens sheet 80 is the vertical direction or the horizontal direction, and it is determined whether the orientation of the setting is correct in light of the driver information which indicates the current printing contents. As a result, in a case where it is possible to determine that the lens sheet 80 is not set to the correct orientation (No in step S103), an alert is displayed on the display section 3*b* (step S109) and the user is prompted to set the lens sheet 80 correctly.

Here, other than the sheets where the lenses Gk extend along the vertical direction of the sheet (the direction where the length is long) in the lens sheet 80 as shown in FIGS. 1A and 1B, there are also sheets of a type where the lenses Gk extend along the horizontal direction of the sheet (the direction where the length is short). Since the sheet transport direction and the lens extension direction are parallel in either case, the case of the latter type is different to the lens sheet 80 shown in FIGS. 1A and 1B and the orientation of the sheet setting is different. Accordingly, the detecting of the sheet setting orientation according to step S103 not only prevents mistakes in the orientation of the setting for the same sheets but is also able to prevent mistakes in the sheet type.

In a case where it is possible to determine that the lens sheet 80 is set to the correct orientation (Yes in step S103), detecting of the cutout portion 87 is performed (step S104). Detecting of the cutout portion 87 is carried out by sequentially sensing, for example, the edge positions of the edges 81A and 81B along the y direction.

Here, the orientation of the appropriate setting of the lens sheet 80 in the present example is an orientation where the edge 81A (the edge which is a reference) is positioned on the home position side of the carriage 7 as shown in FIGS. 6A to 6C and the edge 81B where the cutout portion 87 is formed is positioned on the opposite side to the home position side.

In a case where the cutout portion 87 is positioned on the home position side, that is, in a case where it is possible to determine that the lens sheet 80 is not set to the correct orientation (No in step S105) as a result of detecting the cutout portion 87, an alert is displayed on the display section 3*b* (step S109) and the user is prompted to set the lens sheet 80 correctly. In a case where the cutout portion 87 is positioned on the opposite side to the home position side, that is, in a case where it is possible to determine that the lens sheet 80 is set to the correct orientation (Yes in step S105), detecting of the inclination of the lens sheet 80 is performed (step S106).

It is possible for detecting of the inclination of the lens sheet 80 to calculate the inclination of the lens sheet 80 in the x-y plane by detecting the edge positions at at least two points along the edge direction for at least one edge out of the edges 81A to 81D of the lens sheet 80. Here, in a case where the edge positions of predetermined edges are already detected at two or more points in the cutout portion sensing in step S104, the inclination of the lens sheet 80 may be calculated using the edge positions which are detected.

In a case where the inclination of the lens sheet 80 exceeds a permissible value which is determined in advance (No in step S107), an alert is displayed on the display section 3*b* (step S109) and the user is prompted to reset the lens sheet 80. In a case where the inclination of the lens sheet 80 is equal to or less than the permissible value which is determined in advance (Yes in step S107), recording is executed onto the lens sheet 80 (step S108). The recording onto the lens sheet 80 is performed by alternately executing ink ejecting from the recording head 9, which accompanies the movement operation of the carriage 7, and an operation of sending the lens sheet 80 by a predetermined amount.

Here, in a case where a retry instruction is issued due to an operation by the user after the alert is displayed in step S109 (Yes in step S110), the processes from step S101 are performed again. In a case where a retry instruction is not issued (in a case of a print stopping process), the process is finished (No in step S110).

The above is an example of the flow of the recording operation with regard to the lens sheet 80 and the features of the recording operation of the present invention will be described later.

First, it is basically possible for the controller 30 to execute a bidirectional recording mode, where ink is ejected from the recording head 9 in both a period where the medium and the recording head 9 move relatively in predetermined directions and a period where the medium and the recording head 9 move in the reverse direction to the predetermined direction, and a single direction recording mode, where ink is ejected from the recording head 9 only in a period where the medium and the recording head 9 move relatively in a predetermined direction. In a case where the sheet P which does not have a lens such as normal paper or specialized paper is set as the medium, it is possible to select from among the two recording modes described above, and the respective recording modes are selected for every print job based on driver information such as the print quality and the print speed.

In contrast to this, in a case where recording is performed on the lens sheet 80, only the single direction recording mode is selected.

Here, the "predetermined direction" described above in the bidirectional recording mode and the single direction recording mode in a case where the sheet P which does not have a lens such as normal paper or specialized paper is set as the medium may be the movement direction from the home position side of the carriage 7 toward the opposite direction or may be the reverse direction to the movement direction.

Basically, the "predetermined direction" described above in the single direction mode in a case where the lens sheet 80 is set as the medium may be the movement direction from the home position side of the carriage 7 toward the opposite direction or may be the reverse direction to the movement direction, but the movement direction is limited with regard to the lens sheet 80 as follows.

That is, the controller 30 of the printer 1 according to the present invention controls the recording head 9 so as to perform recording from the side of the reference, which is set as the edge of the one side in the x direction which is a direction which intersects with the transport direction, toward the edge on the other side when ink is ejected from the recording head 9 so as to form an image which corresponds to each of the lenses of the plurality of lenses Gk.

In FIG. 3 and FIG. 11, Sk (where k is an integer of 1 or more) indicates passes (scanning) and the direction of the passes during ink ejecting by the recording head 9. As shown in the diagrams, the controller 30 performs recording with the edge 81A which is formed by being strictly sliced as a reference.

That is, the passes Sk are all performed from the edge 81A which is the reference side toward the edge 81B on the other side and the images (1) to (8) in the example in FIG. 3 are formed in order. When the carriage 7 moves from the edge 81B on the other side toward the edge 81A on the reference side, ejecting of ink is not performed.

In other words, the "predetermined direction" in the "single direction recording mode where ink is ejected from the recording head 9 only in a period where the medium and the recording head 9 move relatively in a predetermined direction" in the present example is the direction in which the recording head 9 moves from the edge 81A on the reference side to the edge 81B on the other side.

The edge 81A is an edge which is formed by slicing with high precision at a valley position in the lenses Gk as described above, and accordingly, by performing recording with the edge 81A as a reference, it is possible to prevent the images (1) to (8) which are to be recorded on one of the lenses Gk being recorded across another lens which is adjacent and it is possible to obtain a favorable visual effect.

In addition, since it is possible to perform recording with high precision by performing recording from the edge 81A which is a reference side toward the edge 81B which is the other side, it is possible to easily record the images which are to be recorded with regard to each of the lenses with high precision without performing complicated controlling.

Here, the controller 30 performs a pass Rk (where k is an integer of 1 or more) prior to the pass Sk. That is, at the start of the recording operation, the recording head and the PW sensor are respectively at the positions which are shown by the reference numerals 9' and 27' in FIG. 11 (the opposite side with regard to the edge 81A which is the reference), and when the recording head and the PW sensor move (pass R1) from these positions to the positions which are shown by the reference numerals 9 and 27 (the side of the edge 81A which is the reference), the position of the edge 81A which is the reference side is detected using the PW sensor 27 and the edge position which is detected is set as the recording start position of the next pass (pass S1).

Below, the position of the edge 81A is detected in the pass Rk in the same manner and the edge position which is detected is set as the recording start position of the next pass Sk. Due to this, it is possible to perform recording with high precision even when the lens sheet 80 is slightly inclined.

Here, the PW sensor 27 in the present example is provided at a position (the upper side in FIG. 11) which is on the opposite side (the left side in FIG. 11) to the home position side with regard to the recording head 9 in the x direction and which is offset in the opposite direction to the A direction in the y direction. However, this is an example and the PW sensor may be provided at other positions.

Here, in a case where recording is performed on the lens sheet 80, the movement speed of the carriage 7 (the recording head 9) during ink ejecting (the pass Sk) may be a slower speed than the movement speed of the carriage 7 (the recording head 9) when recording is performed on the sheet P such as normal paper or specialized paper. Due to this, it is possible to land the ink droplets with high precision with regard to each of the lenses Gk. Here, in a case of high quality printing onto normal paper, specialized paper, or the like, the movement speed of the carriage 7 (the recording head 9) is a slower speed compared to a case where printing is carried out with speed as a priority, but the movement speed of the carriage 7 (the recording head 9) may be an even slower speed in a case where recording is performed onto the lens sheet 80.

In addition, in the same manner, the movement speed of the carriage 7 in the pass Rk during edge detecting may be a slower speed than the movement speed of the carriage 7 (the recording head 9) when recording is performed on the sheet P such as normal paper. Due to this, it is possible to detect the edge position of the edge 81A which is the reference with high precision. In addition, for the same reason, the movement speed of the carriage 7 in the pass Rk during edge detecting may be a slower speed than the movement speed of the carriage 7 during the pass Sk during ink ejecting. Here, the movement speed of the carriage 7 in the pass Rk during edge detecting may be slower as described above only before and after crossing across the edge 81A and faster in the other regions. Due to this, it is possible to detect the edge position of the edge 81A which is the reference with high precision while suppressing a decrease in the throughput.

In addition, in the controlling shown in FIG. 10, the user is prompted to reset the lens sheet 80 in a case where the orientation of the edge 81A which is the reference is not correct as a result of detecting of the cutout portion 87 in step S104, but since it is confirmed which side the edge 81A which is the reference is (the home position side or the opposite side to the home position side) due to the detecting of the cutout portion 87, control may be carried out so as to perform recording from the side of the edge 81A which is confirmed based on the detection result of the cutout portion 87.

3. OTHER EXAMPLES

Figure 12:
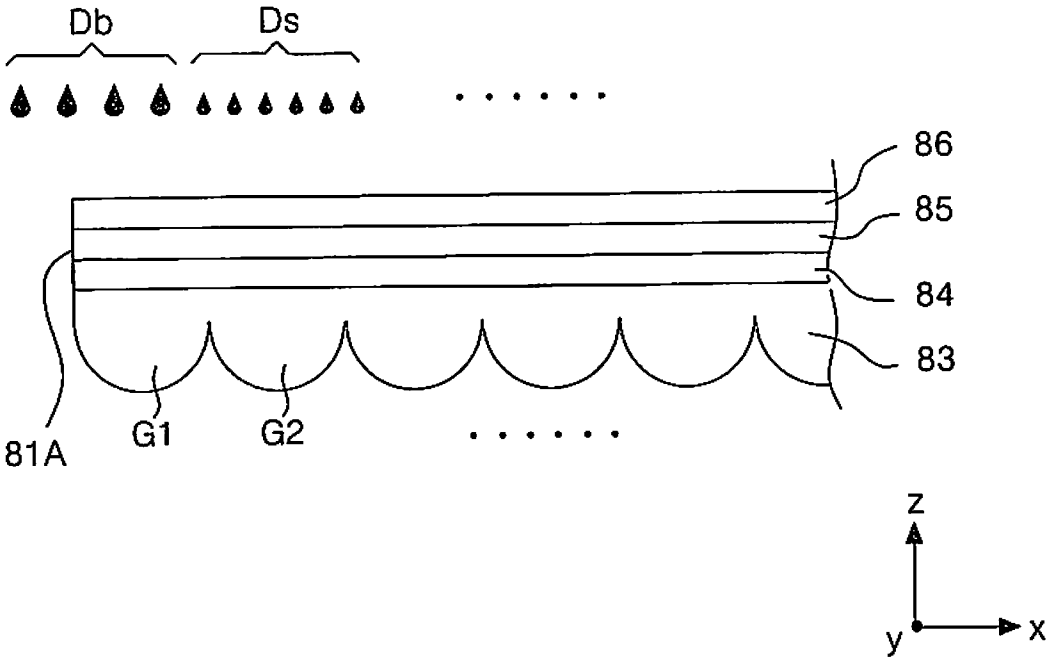
FIG. 12 is a diagram schematically illustrating the size of ink droplets which are ejected with regard to the lens sheet.
Figure 13:
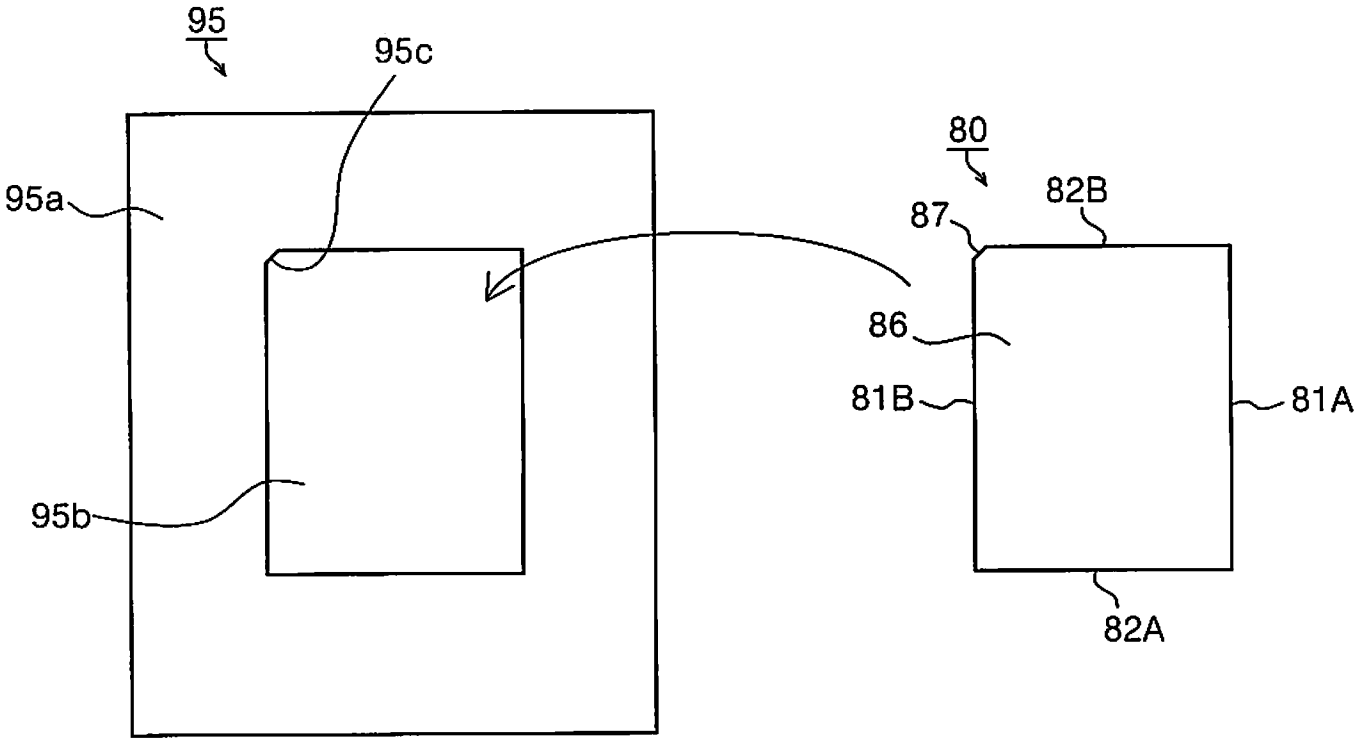
FIG. 13 is a planar diagram illustrating a tray where the lens sheet is held.

Below, the features (1) to (6) which are able to be further arbitrarily added to the examples described above will be described with reference to FIG. 12 and beyond. FIG. 12 is a diagram schematically illustrating the size of ink droplets which are ejected with regard to the lens sheet 80, FIG. 13 is a planar diagram illustrating a tray 95 where the lens sheet 80 is held, and FIGS. 14A and 14B, FIGS. 15A and 15B are diagrams illustrating other embodiments of a support member. In addition, FIGS. 16A to 16D are diagrams illustrating embodiments with different recording heads.

(1) As shown in FIG. 12, it is possible for the particle diameter of ink Db which is ejected from the recording head 9 toward regions at both end sections of the lens sheet 80 to be larger than the particle diameter of ink Ds which is ejected toward a region which is between the regions at both end sections.

That is, in a case of performing so-called borderless recording where recording is performed without a margin at the end sections of the lens sheet 80, there is a concern that a portion of ink, which is discarded in a region which is separated from the end section of the lens sheet 80, will float due to becoming a mist, foul the lens sheet 80 by being reattached to the lens sheet 80, and have an adverse effect on the constituent components of the apparatus due to becoming attached. Here, the end section of the lens sheet 80 has the meaning of either of the end section in the width direction (the x direction) or the end section in the transport direction (the y direction).

Therefore, by the particle diameter of the ink Db which is ejected from the recording head 9 toward the regions of both end sections of the lens sheet 80 being larger than the particle diameter of the ink Ds which is ejected toward the region between the regions of both end sections as described above, there is a tendency for the ink Db which is discarded to a region which is separated from the end section of the lens sheet 80 to fall and it is possible to suppress the ink from becoming a mist and floating.

(2) As shown in FIG. 13, the lens sheet 80 may be set in the tray 95, transported inside the printer in a state of being set in the tray 95, and recording may be performed on the lens sheet 80 in this manner.

The reference numeral 95*b* in FIG. 13 indicates a concave section which is formed in a shape which corresponds to the outer shape of the lens sheet 80. The concave section 95*b* has a cutout portion 95*c* in a position which corresponds to the cutout portion 87 of the lens sheet 80.

In addition, the concave section 95*b* is formed with a depth which corresponds to the thickness of the lens sheet 80 and is configured such that an upper surface 95*a* of the tray 95 and an upper surface of the ink absorbing layer 86 are flush in a state where the lens sheet 80 is set in the concave section 95*b*.

In a configuration where recording is performed by the recording head 9 in a state where the lens sheet 80 is held in the tray 95 as above, it is possible to carry out transporting by stabilizing the transport path in the printer 1 even in a case where the size of the lens sheet 80 is small.

(3) As shown in FIGS. 14A and 14B, and FIGS. 15A and 15B, there may be a configuration such that ribs 21*b* move up and down in conjunction with displacement of edge guides 4*a*' and 4*b*', and both edges of the lens sheet 80 are guided. Here, the tray 4 and a support member 21' are provided at substantially the same position in the z direction (the height direction), but the tray 4 and the support member 21' are illustrated by being divided into two diagrams of A and B in FIGS. 14A and 14B, and FIGS. 15A and 15B for convenience of description. However, the positions of the tray 4 and the support member 21' match in the x direction in the two diagrams of A and B.

Figure 14A:
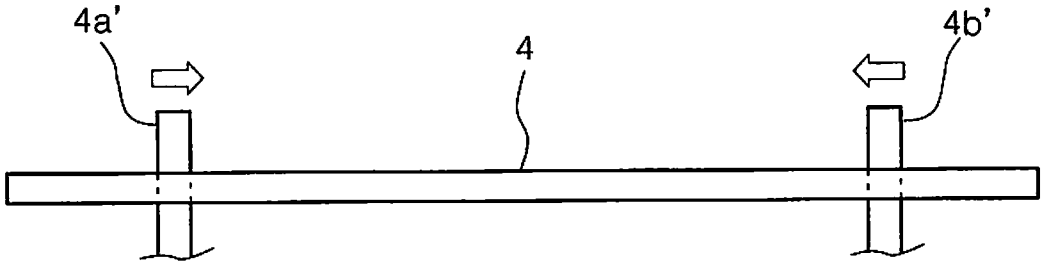
FIG. 14A is a diagram illustrating other embodiment of a support member.
Figure 14B:
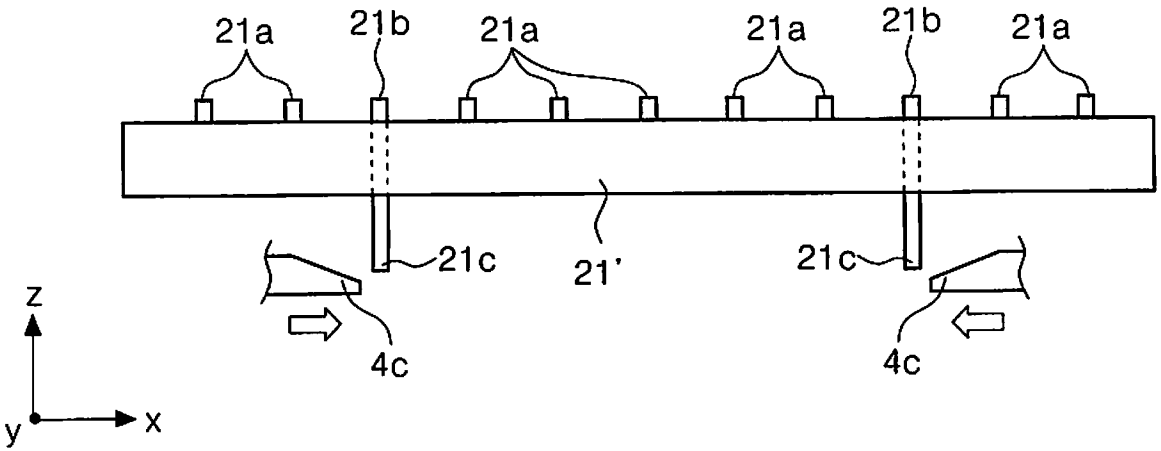
FIG. 14B is the diagram illustrating other embodiment of the support member.

Out of the plurality of ribs which are provided at appropriate intervals along the x direction in the support member 21', the ribs which are indicated by the reference numeral 21*a* are provided to be fixed and the ribs which are indicated by the reference numeral 21*b* are provided so as to be able to be displaced by sliding in the height direction. In a case where recording is performed on the sheet P with a width which is different to the lens sheet 80, the ribs 21*a* and 21*b* are positioned at the same height as the top section of the sheet P as shown in FIGS. 14A and 14B.

Cams 4*c* are respectively joined to the edge guides 4*a*' and 4*b*' which are provided so as to be able to be displaced by sliding in the x direction in the tray 4 where the lens sheet 80 is held. The cams 4*c* are provided in the lower sections of the ribs 21*b* so as to be able to be displaced by sliding in the x direction and are joined to the edge guides 4*a*' and 4*b*' by a linking rod which is omitted from the illustration in FIGS. 14A and B and FIGS. 15A and B and which extends from the lower side of the tray 4 to the lower side of the support member 21'.

Figure 15A:
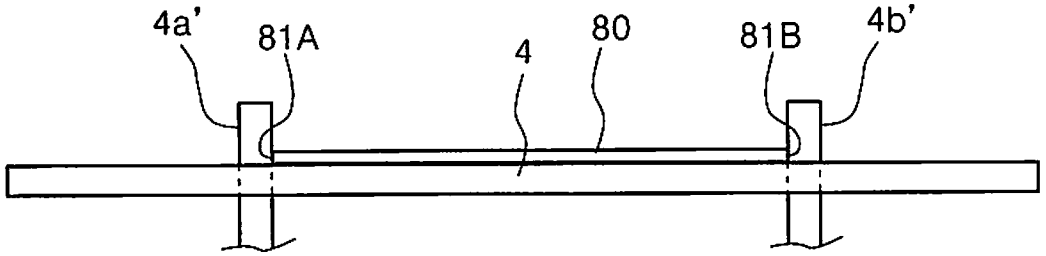
FIG. 15A is a diagram illustrating other embodiment of a support member.
Figure 15B:
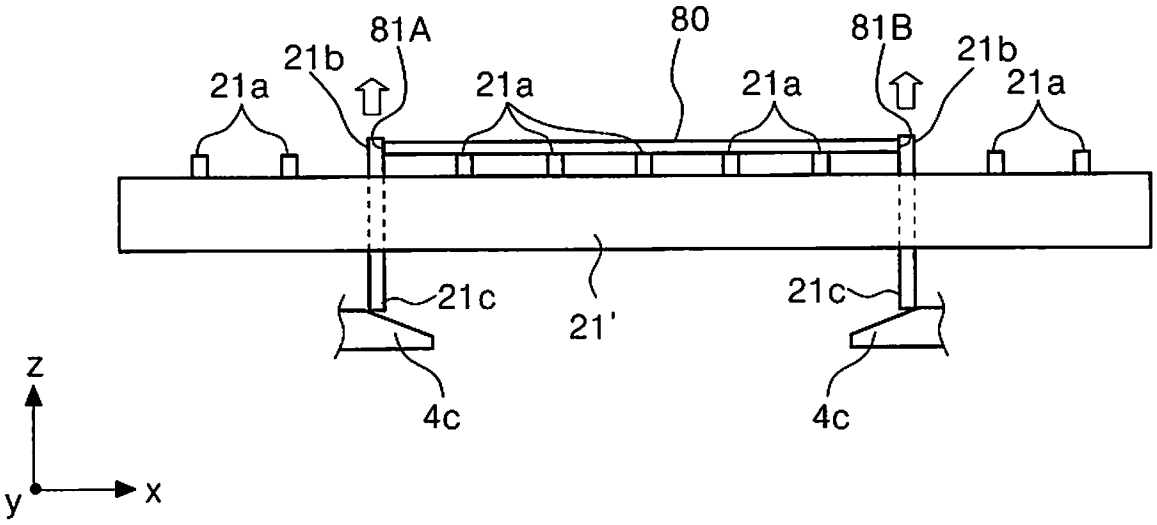
FIG. 15B is the diagram illustrating other embodiment of the support member.

When the edge guides 4*a*' and 4*b*' are displaced by sliding from the state in FIG. 14 to the edge position of the lens sheet 80 in order to perform recording on the lens sheet 80, the cams 4*c* engage with lower end sections 21*c* of the ribs 21*b* as shown in FIGS. 15A and B and the ribs 21*b* are pushed upward.

Due to this, it is possible for the ribs 21*b* to guide both sides of the lens sheet 80.

That is, since the ribs 21*b* and 21*b* as well as the edge guides 4*a*' and 4*b*' which are provided in the tray 4 guide the edges of the lens sheet 80, in particular, it is possible to appropriately positionally align the lens sheet 80 while executing recording and it is possible to obtain a favorable recording result.

Figure 16A:
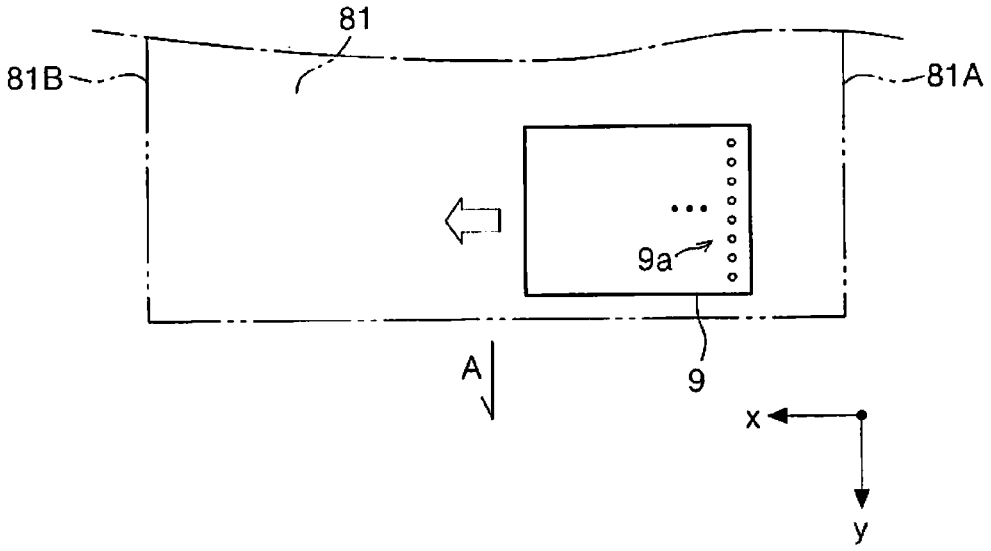
FIG. 16A is a diagram illustrating embodiment with different recording head.
Figure 16B:
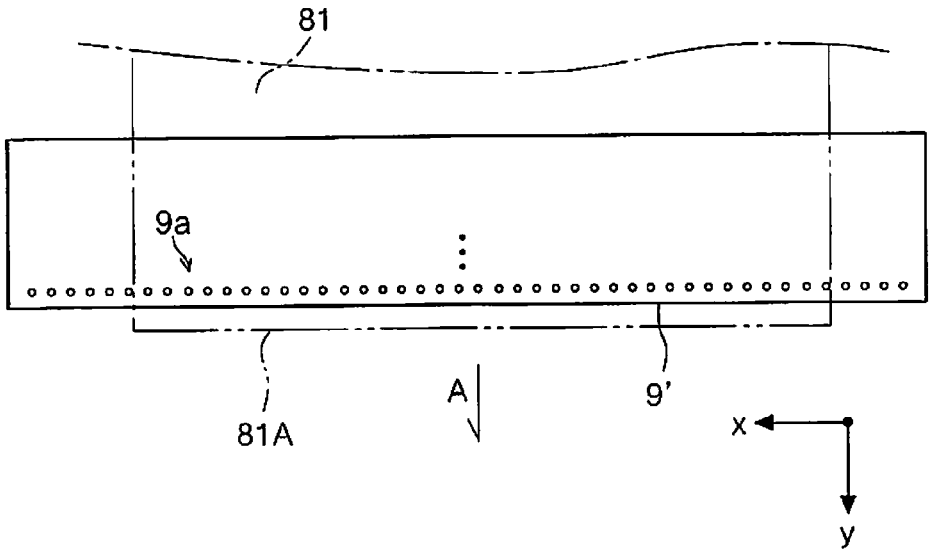
FIG. 16B is a diagram illustrating the embodiment with the different recording head.
Figure 16C:
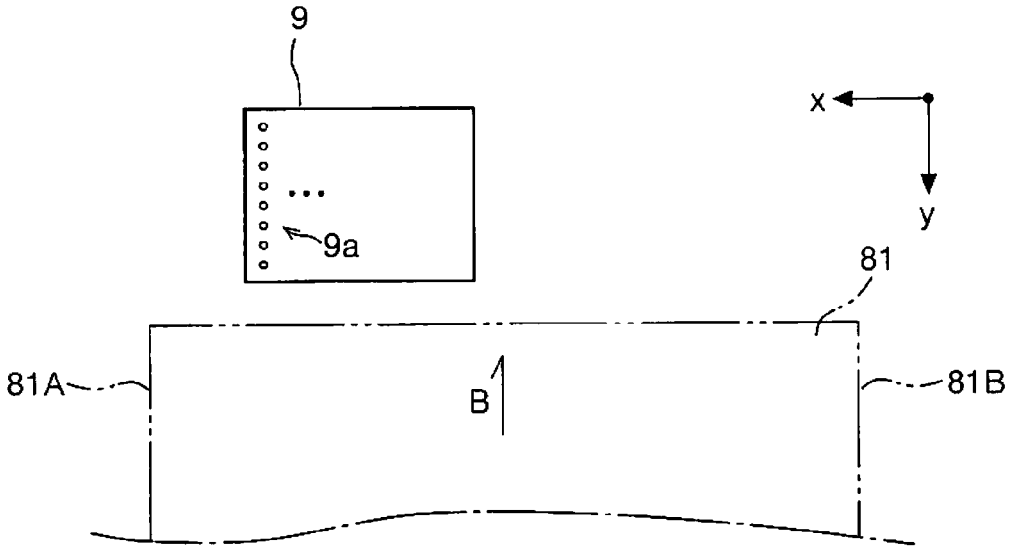
FIG. 16C is a diagram illustrating the embodiment with the different recording head.
Figure 16D:
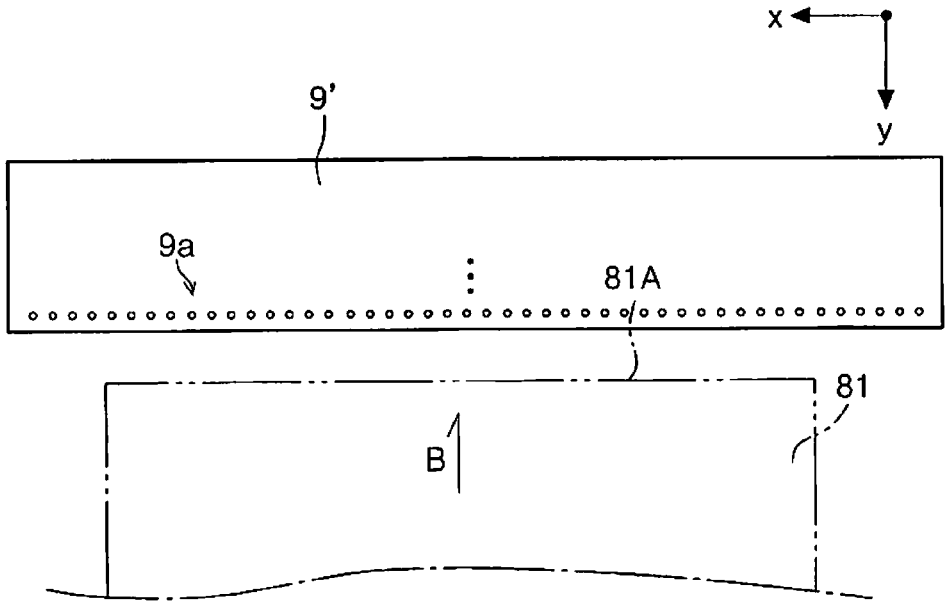
FIG. 16D is a diagram illustrating the embodiment with the different recording head.

(4) In the example described above, the printer 1 is a serial type of printer which performs recording while moving the recording head 9 in the x direction as shown in FIG. 16A and FIG. 16C, but the printer 1 may be a line head type of printer which is provided with a recording head 9' which has a size which covers the entirety of the sheet in the width direction and which is fixed as shown in FIG. 16B and FIG. 16D.

Here, the recording head 9 which ejects ink while moving in the x direction in FIG. 16A and FIG. 16C is provided with a plurality of nozzle rows 9*a* which are formed by arranging a plurality of ink ejecting holes along the transport direction of the lens sheet 80 and spaced at predetermined intervals along the x direction. That is, the direction in which the nozzle rows 9*a* extend and the direction in which the lenses Gk extend are parallel. In addition, the direction in which the nozzle rows 9*a* extend and transport direction of the lens sheet 80 are parallel. Here, one (one row) of the nozzle rows 9*a* is a nozzle row which ejects a predetermined coloring material (for example, one color out of yellow, cyan, magenta, and black).

In contrast to this, the recording head 9' shown in FIG. 16B and FIG. 16D is provided with a plurality of nozzle rows 9*a* which are formed by arranging a plurality of ink ejecting holes along a direction which is orthogonal to the transport direction of the lens sheet 80 and spaced at predetermined intervals along the transport direction of the lens sheet 80, but the direction in which the lenses Gk extend is the x direction and transporting is carried out by setting the edge 81A which is the reference as the front end. The single direction recording mode in this example is different to the example described above, and the medium and the recording head are relatively moved by the medium being moved instead of the recording head.

Even in a case of using the recording head 9' which has a size which covers the entirety of the sheet in the width direction and which is provided to be fixed as above, recording is performed from the edge 81A which is the reference toward the edge on the other side and it is possible to obtain a favorable recording result. Here, one (one row) of the nozzle rows 9*a* is a nozzle row which ejects a predetermined coloring material (for example, one color out of yellow, cyan, magenta, and black).

Here, in FIG. 16A and FIG. 16C, the direction in which the nozzle rows 9*a* extend and the direction in which lenses Gk extend may intersect (for example, may be orthogonal). In addition, in FIG. 16B and FIG. 16D, the direction in which the nozzle rows 9*a* extend and the direction in which lenses Gk extend may intersect (for example, may be orthogonal).

(5) The medium transport path in the printer 1 may be configured as shown in FIGS. 17A and 17B and FIG. 18A and FIG. 18B. FIGS. 17A and 17B and FIG. 18A and FIG. 18B are diagrams illustrating another embodiment of another medium transport path. In FIGS. 17A and 17B and FIG. 18A and FIG. 18B, the same reference numerals are given where the configuration is the same as the configuration shown in FIG. 8A and FIG. 9A and FIG. 9C and description thereof is omitted below.

Figure 17A:
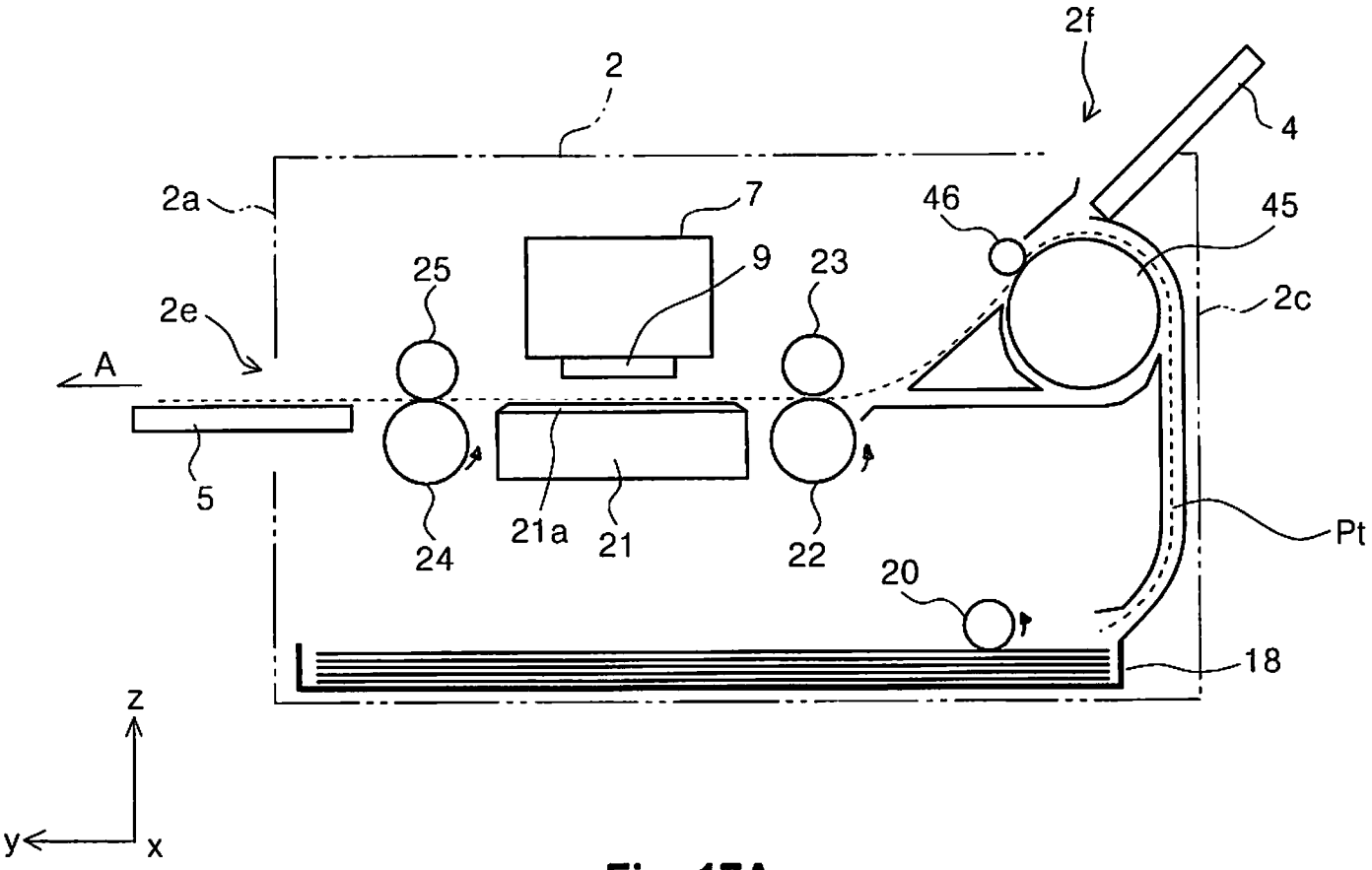
FIG. 17A is a diagram illustrating another embodiment of a medium transport path.
Figure 18A:
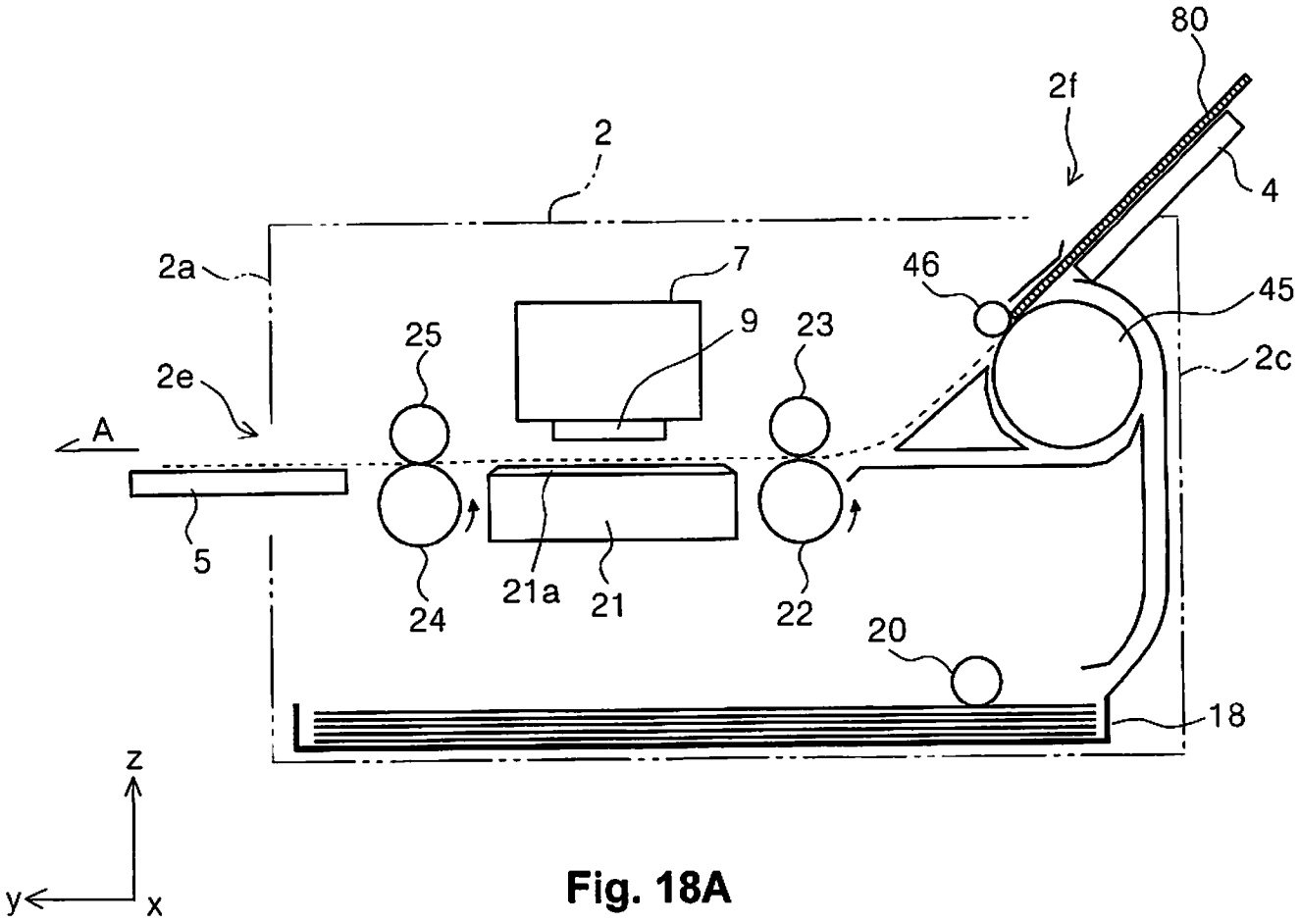
FIG. 18A is a diagram illustrating another embodiment of the medium transport path.

In the medium transport path shown in FIG. 17A and FIG. 18A, a tray 4', which is provided on the apparatus rear surface 2*c* side, is provided with an inclined posture instead of a horizontal posture. An opening 2*f* where it is possible for the medium to be inserted is formed in the upper surface of the apparatus.

Figure 17B:
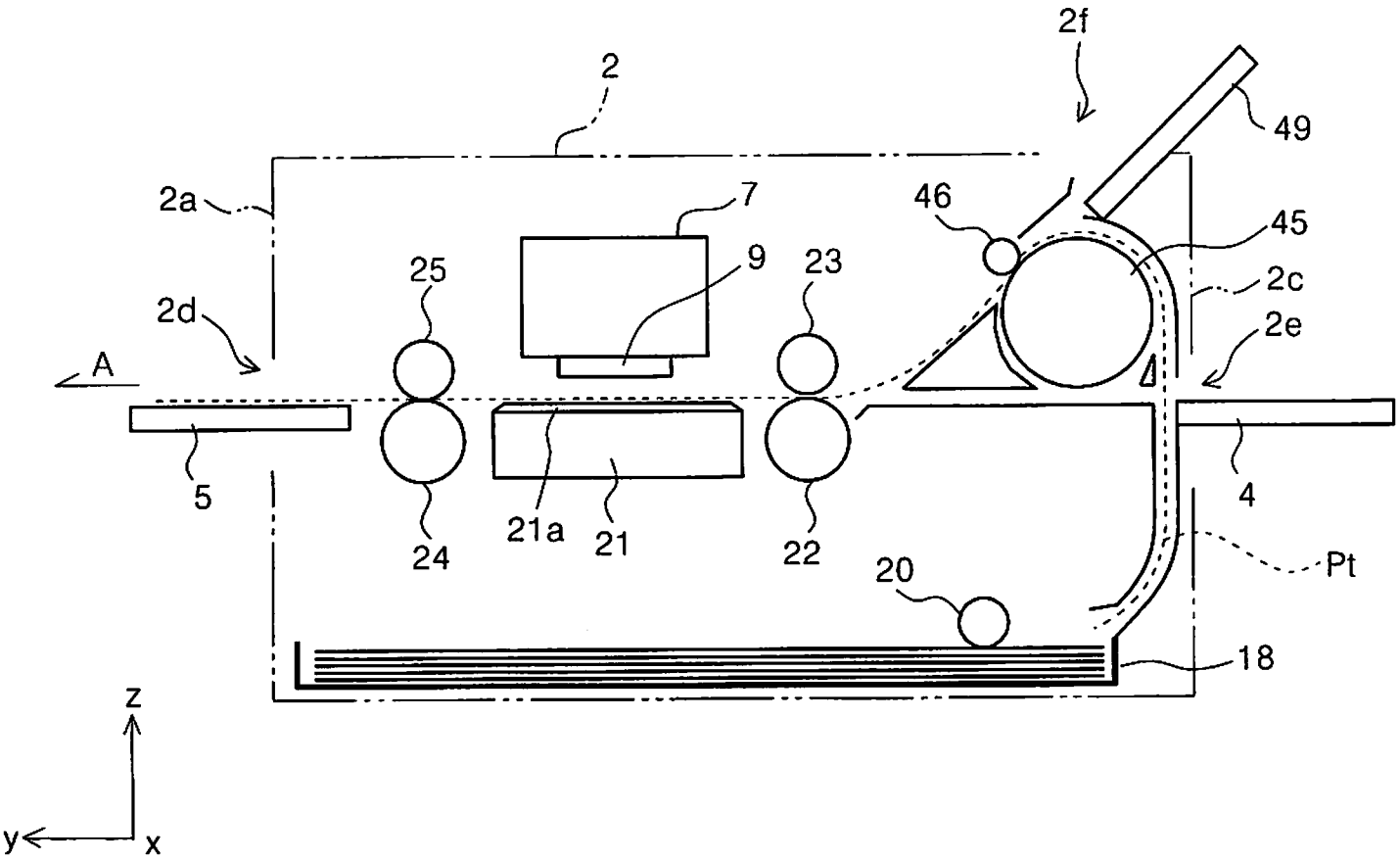
FIG. 17B is a diagram illustrating another embodiment of the medium transport path.
Figure 18B:
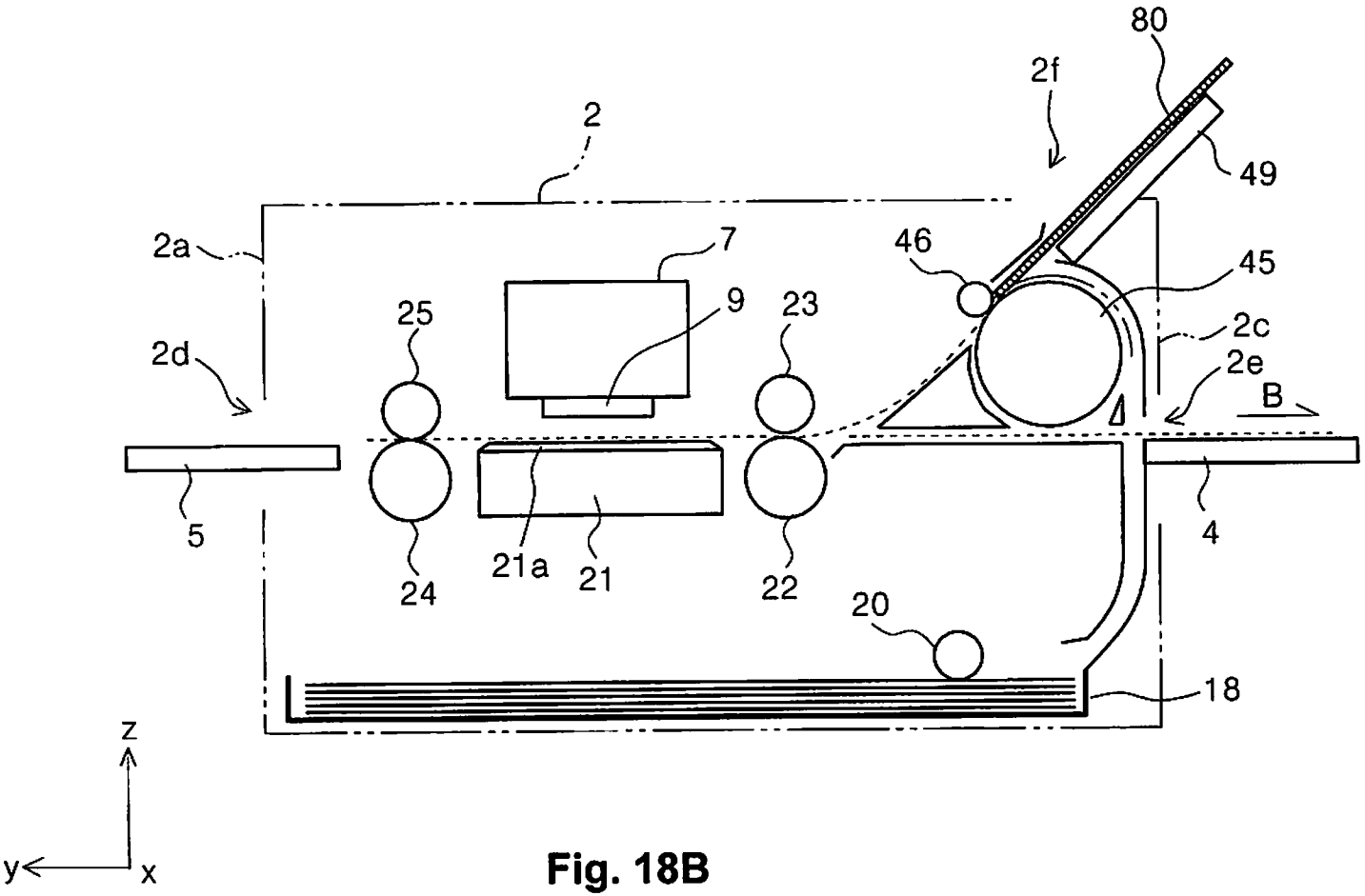
FIG. 18B is a diagram illustrating another embodiment of the medium transport path.

In addition, in the medium transport path shown in FIG. 17B and FIG. 18B, a tray 49 is provided with an inclined posture on the side of the apparatus rear surface 2*c*. An opening 2*f* where it is possible for the medium to be inserted is formed on the upper surface of the apparatus.

In addition, an intermediate roller 45 which is driven to rotate and a driven roller 46 which is rotated by being driven are provided upstream of the first driving roller 22 and the first driven roller 23. The sheet P which is sent out from the sheet cassette 18 passes by the intermediate roller 45 as shown by the dashed line Pt in FIGS. 17A and 17B and reaches the first driving roller 22 and the first driven roller 23 by being curved and inverted.

On the other hand, the lens sheet 80 is held in the tray 4'. At this time, the intermediate roller 45 is in a driving state and the front end of the lens sheet 80 which is held in the tray 4' is inserted between the intermediate roller 45 and the driven roller 46 and is sent toward the first driving roller 22 and the first driven roller 23. Here, since the lens sheet 80 has flexibility, it is possible for the lens sheet 80 to bend in the transport path between the intermediate roller 45 and the first driving roller 22.

Here, it is possible to execute control in order to correct skew in the lens sheet 80. For example, when the lens sheet 80 to which feeding force is applied from the intermediate roller 45 reaches the first driving roller 22, the first driving roller 22 rotates in the reverse rotation direction (the clockwise direction in FIGS. 18A and 18B) and the front end of the lens sheet 80 hits up against between the first driving roller 22 and the first driven roller 23 in this state. Since the intermediate roller 45 and the driven roller 46 are provided only at the central position in the width direction of the medium, it is possible for the lens sheet 80 to be rotated centered on the nip position using the intermediate roller 45 and the driven roller 46 when the front end of the lens sheet 80 hits up against between the first driving roller 22 and the first driven roller 23. Due to this, the skew in the lens sheet 80 is corrected.

Here, it is possible for the controlling in order to correct for skew in the sheet P which is sent out from the sheet cassette 18 to be different to the case of the lens sheet 80. For example, after the front end of the sheet P is taken into between the first driving roller 22 and the first driven roller 23 and the front end of the sheet P is sent to the downstream side (in the A direction) by a predetermined amount, the first driving roller 22 is reversed in a state where the intermediate roller 45 is stopped and the front end of the sheet P is discharged from between the first driving roller 22 and the first driven roller 23 to the upstream side. Due to this, the sheet P is bent between the first driving roller 22 and the intermediate roller 45, the front end of the sheet copies the shape between the first driving roller 22 and the first driven roller 23, and the skew is corrected.

In FIG. 18A, the lens sheet 80 where recording is performed is discharged toward the tray 5 which is provided on the apparatus front surface 2*a* side and supported by the tray 5. Here, out of the sheets P which do not have a lens, it is possible for a sheet with strong resilience (with low flexibility) such as cardboard to be fed via the tray 4' in the same manner as the lens sheet 80.

In addition, in FIG. 18B, the lens sheet 80 where recording is performed is discharged toward the tray 4 which is provided on the apparatus rear surface 2*c* side and supported by the tray 4. Here, out of the sheets P which do not have a lens, it is possible for a sheet with strong resilience (with low flexibility) such as cardboard to be fed via the tray 49 in the same manner as the lens sheet 80.

(6) As a liquid which is ejected from the recording head 9, it is possible to add liquids such as a coating agent which protects the ink absorbing layer 86 after ink is ejected with regard to the ink absorbing layer 86 of the lens sheet 80, or white ink which forms a base for printing, for example, an address or the like with regard to the ink absorbing layer 86 after an image is formed.

In this case, after the lens sheet 80 is sent out from the tray 4 on the apparatus rear surface and ejecting of ink is performed in order to form an image in the process of transporting the lens sheet 80 in an A direction, post-processes may be performed such as ejecting a coating agent or ejecting a white ink described above in the process of carrying out transporting in a B direction.

Furthermore, it is obvious that each of the constituent components described above is not limited to the contents which are disclosed and appropriate modifications are possible.

For example, the lens layer 83 of the lens sheet 80 is used as a lenticular lens, but another lens layer which is formed by arranging a plurality of lens bodies in lines, such as a fly array lens, may be used.

Additionally, the configuration in the present embodiment is a so-called on-carriage type where the ink cartridges 8A to 8D are mounted in the carriage 7, but the configuration may be a so-called off-carriage type where the ink cartridges 8A to 8D are provided independently from the carriage 7 and the ink cartridges 8A to 8D and the recording head 9 are connected with an ink tube. In this case, the ink cartridges 8A to 8D as ink accommodating sections may be either provided inside the housing 2 or provided outside the housing 2.

The invention claimed is:

1. A recording apparatus comprising:

a recording head configured to perform recording with regard to a first target recording medium, and a second target recording medium with a sheet shape, the second target recording medium being a target recording medium of a type which is different to the first target recording medium and having a lens layer which is formed by arranging lenses, which extend in a first direction, in a plurality of lines in a second direction which is a direction orthogonal to the first direction; and a control unit configured to control the recording head, when recording is performed on the first target recording medium, the control unit being configured to select either of a bidirectional recording mode where ink is ejected from the recording head in both a period where the first target recording medium and the recording head move relatively in a predetermined direction and a period where the first target recording medium and the recording head move in a reverse direction to the predetermined direction, and a single direction recording mode where ink is ejected from the recording head only in a period where the first target recording medium and the recording head move relatively in a predetermined direction, and the control unit being configured to select a single direction recording mode, when recording is performed on the second target recording medium, where ink is ejected from the recording head only in a period where the second target recording medium and the recording head move relatively in a predetermined direction, and to control the recording head so as to perform recording from a side of a reference, which is set on an edge on one side in the second direction in the target recording medium, toward an edge on the other side, when ink is ejected from the recording head toward the second target recording medium so as to form an image which corresponds to each of the lenses of the plurality of lenses.

2. The recording apparatus according to claim 1, further comprising:

a discharge section where the first target recording medium where recording has been performed is discharged, and a holding section which is provided on a side which is far from the discharge section so as to interpose a recording region of the recording head and where the second target recording medium is held before recording is started, wherein the second target recording medium is transported from the holding section to the recording region, recording is performed on the second target recording medium, and the second target recording medium is discharged toward the discharge section.

3. The recording apparatus according to claim 1, further comprising:

a first discharge section where the first target recording medium is discharged, and a holding section which is provided on the same side as the first discharge section with regard to a recording region of the recording head and where the second target recording medium is held before recording is started, wherein the second target recording medium is transported from the holding section to the recording region, recording is performed on the second target recording medium, and the second target recording medium is discharged toward a second discharge section which is provided on a side which is far from the first discharge section so as to interpose the recording region.

4. The recording apparatus according to claim 1, further comprising:

a first discharge section where the first target recording medium where recording has been performed is discharged, and a holding section which is provided on a side which is far from the first discharge section so as to interpose a recording region of the recording head and where the second target recording medium is held before recording starts, wherein the second target recording medium is transported from the holding section to the recording region, recording is performed on the second target recording medium, and the second target recording medium is discharged toward a second discharge section which is provided on a side which is far from the first discharge section so as to interpose the recording region.

5. The recording apparatus according to claim 1, further comprising:

an discharge section where the first target recording medium where recording has been performed is discharged, and a holding section which is provided on the same side as the discharge section with regard to a recording region of the recording head and where the second target recording medium is held before recording starts, wherein the second target recording medium is transported from the holding section to the recording region, recording is performed on the second target recording medium, and the second target recording medium is discharged toward the holding section.

6. A recording apparatus, wherein a width of the target recording medium according to claim 1 in the second direction of a lens, which is formed at an edge on the side of the reference, is equivalent to a width in the second direction of a lens which is adjacent to the lens which is formed at the edge.

7. The recording apparatus according to claim 6, wherein the first direction is a transport direction of the second target recording medium.

8. The recording apparatus according to claim 7, wherein the recording head is configured to perform recording while moving in the second direction.

9. The recording apparatus according to claim 8, wherein the recording head has a nozzle row which is formed by arranging a plurality of liquid ejecting holes that are configured to eject a predetermined coloring material along the transport direction of the second target recording medium.

10. The recording apparatus according to claim 7 wherein the first direction is a direction orthogonal to the transport direction of the second target recording medium.

11. The recording apparatus according to claim 10, wherein the recording head is fixedly provided, and recording is performed in a process where the second target recording medium is transported.

12. The recording apparatus according to claim 11, wherein the recording head has a nozzle row which is formed by arranging a plurality of liquid ejecting holes that are configured to eject a predetermined coloring material along a direction orthogonal to the transport direction of the second target recording medium.

13. The recording apparatus according to claim 7, further comprising:

a detecting unit configured to identify an edge which is set as the reference and detect an identification mark which is formed on the second target recording medium, wherein the control unit is configured to control the recording head so as to perform recording from the side of the reference toward the edge on the other side based on detecting of the identification mark by the detecting unit.

14. The recording apparatus according to claim 13, wherein the identification mark is a notch where one corner section of the second target recording medium is cut out.

15. The recording apparatus according to claim 14, wherein the control unit is configured to display content on a display section based on detecting of the identification mark.

16. The recording apparatus according to claim 7, wherein a tray which carries the second target recording medium is configured so as to be transported, and recording is performed on the second target recording medium using the recording head in a state of being carried in the tray.

17. The recording apparatus according to claim 7, wherein a particle diameter of a liquid which is ejected from the recording head toward regions at both end sections of the second target recording medium is larger than a particle diameter of a liquid which is ejected toward a region which is between the regions at both end sections.

* * * * *